US011850479B2

(12) United States Patent
Morales et al.

(10) Patent No.: US 11,850,479 B2
(45) Date of Patent: Dec. 26, 2023

(54) VARIABLE THICKNESS FACE PLATE FOR A GOLF CLUB HEAD

(71) Applicant: Karsten Manufacturing Corporation, Phoenix, AZ (US)

(72) Inventors: Eric J. Morales, Laveen, AZ (US); Martin R. Jertson, Phoenix, AZ (US); Ryan M. Stokke, Anthem, AZ (US); Jacob T. Clarke, Phoenix, AZ (US); Evan Greer, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 17/087,462

(22) Filed: Nov. 2, 2020

(65) Prior Publication Data

US 2021/0046361 A1 Feb. 18, 2021

Related U.S. Application Data

(63) Continuation-in-part of application No. 15/973,386, filed on May 7, 2018, now Pat. No. 11,161,019.

(60) Provisional application No. 62/928,986, filed on Oct. 31, 2019, provisional application No. 62/608,363, filed on Dec. 20, 2017, provisional application No. 62/502,482, filed on May 5, 2017.

(51) Int. Cl.
*A63B 53/04* (2015.01)

(52) U.S. Cl.
CPC ..... *A63B 53/0462* (2020.08); *A63B 53/0412* (2020.08); *A63B 53/0466* (2013.01)

(58) Field of Classification Search
CPC . A63B 53/042; A63B 53/048; A63B 53/0412; A63B 53/0416; A63B 53/0437; A63B 53/0462; A63B 53/04666
See application file for complete search history.

(56) References Cited

U.S. PATENT DOCUMENTS

| | | | | |
|---|---|---|---|---|
| 819,900 | A | 5/1906 | Martin | |
| 5,318,300 | A | 6/1994 | Schmidt et al. | |
| 5,333,872 | A * | 8/1994 | Manning | A63B 53/047 473/291 |
| 5,676,605 | A | 7/1997 | Kobayashi | |
| 5,797,807 | A | 8/1998 | Moore | |
| 5,830,084 | A | 11/1998 | Kosmatka | |
| 5,921,869 | A | 7/1999 | Blough et al. | |
| 5,954,596 | A | 9/1999 | Noble et al. | |
| 5,993,331 | A | 11/1999 | Shieh | |
| 6,319,150 | B1 | 11/2001 | Werner et al. | |
| 6,354,962 | B1 | 3/2002 | Galloway et al. | |
| 6,368,234 | B1 | 4/2002 | Galloway | |
| 6,381,828 | B1 | 5/2002 | Boyce et al. | |
| 6,428,426 | B1 | 8/2002 | Helmstetter et al. | |

(Continued)

FOREIGN PATENT DOCUMENTS

| | | |
|---|---|---|
| CN | 101244328 | 8/2008 |
| JP | 2014188194 | 10/2014 |

OTHER PUBLICATIONS

International Search Report and Written Opinion for PCT Application No. PCT/US2018/031441, 9 pages, dated Jul. 31, 2018.

*Primary Examiner* — William M Pierce

(57) ABSTRACT

Disclosed herein is a golf club heads having a body portion and a face portion, wherein the face portion comprises a variable thickness profile disposed at an angle on the rear surface of the face plate.

12 Claims, 8 Drawing Sheets

(56) References Cited

U.S. PATENT DOCUMENTS 6,478,693 B2 * 11/2002 Matsunaga ..... A63B 53/0466 473/345
6,508,722 B1 1/2003 McCabe et al.
6,602,150 B1 8/2003 Kosmatka
6,605,007 B1 8/2003 Bissonnette et al.
6,623,377 B2 9/2003 Evans et al.
6,800,038 B2 10/2004 Willett et al.
6,800,040 B2 * 10/2004 Galloway ..... A63B 60/00 473/345
6,899,638 B2 5/2005 Iwata et al.
7,029,403 B2 4/2006 Rice et al.
7,220,190 B2 5/2007 Hirano
7,261,643 B2 8/2007 Rice et al.
7,331,877 B2 2/2008 Yamaguchi et al.
7,338,388 B2 3/2008 Schweigert et al.
7,367,899 B2 5/2008 Rice et al.
7,413,517 B2 8/2008 Butler, Jr. et al.
7,442,132 B2 10/2008 Nashio
7,549,934 B2 6/2009 Rice
7,614,964 B2 11/2009 Matsunaga
7,618,331 B2 11/2009 Hirano
7,704,162 B2 4/2010 Rice et al.
7,850,541 B2 12/2010 Meyer et al.
7,874,937 B2 1/2011 Chao
7,874,938 B2 1/2011 Chao
7,935,003 B2 5/2011 Matsunaga et al.
7,980,963 B2 7/2011 Rice et al.
8,038,544 B2 10/2011 Meyer
8,047,930 B2 11/2011 Rice et al.
8,047,931 B2 11/2011 Yakota
8,262,501 B2 9/2012 Curtis et al.
8,272,975 B2 9/2012 Morin et al.
8,826,512 B2 9/2014 Schweigert
8,956,246 B2 2/2015 Myrhum et al.
8,986,133 B2 3/2015 Bennett et al.
9,162,115 B1 10/2015 Beach et al.
9,220,954 B2 12/2015 Matsunaga
9,526,956 B2 12/2016 Murphy et al.
9,636,553 B1 5/2017 Myers
9,901,789 B2 2/2018 Kitagawa et al.
9,914,030 B2 3/2018 Cleghorn et al.
9,937,389 B2 4/2018 Kitagawa et al.
9,937,390 B2 4/2018 Luttrell et al.
9,950,219 B2 4/2018 Larson et al.
9,987,524 B2 6/2018 Jertson et al.
10,207,163 B2 2/2019 Mizutani
10,213,662 B2 2/2019 Seluga et al.
2001/0051548 A1 * 12/2001 Iwata ..... A63B 53/04 473/329
2002/0065146 A1 5/2002 Kusumoto
2004/0083596 A1 5/2004 Willett et al.
2005/0101407 A1 5/2005 Hirano
2006/0063606 A1 3/2006 Schweigert et al.
2006/0079345 A1 4/2006 Gibbs et al.
2006/0111198 A1 5/2006 Matsunaga
2008/0090675 A1 4/2008 Matsunaga et al.
2008/0096689 A1 4/2008 Oyama
2008/0248896 A1 10/2008 Hirano
2009/0088271 A1 4/2009 Beach et al.
2009/0163292 A1 6/2009 Chao
2009/0227389 A1 9/2009 Meyer et al.
2009/0258724 A1 10/2009 Rice
2011/0105243 A1 5/2011 Brunski et al.
2011/0151994 A1 6/2011 Curtis et al.
2011/0319190 A1 * 12/2011 Wada ..... A63B 53/0466 473/349
2012/0149495 A1 * 6/2012 Wada ..... A63B 53/0466 473/349
2013/0029782 A1 1/2013 Goto
2013/0109500 A1 5/2013 Boyd et al.
2013/0331201 A1 12/2013 Wahl et al.
2013/0344990 A1 12/2013 Slaughter
2014/0080634 A1 3/2014 Golden et al.
2016/0096083 A1 4/2016 Boggs et al.

* cited by examiner

VARIABLE THICKNESS FACE PLATE FOR A GOLF CLUB HEAD

CROSS REFERENCE TO RELATED APPLICATIONS

This claims the benefit of U.S. Provisional Patent Application No. 62/928,986, filed on Oct. 31, 2019 and is a continuation-in-part of U.S. patent application Ser. No. 15/973,386, filed on May 7, 2018, which claims the benefit of U.S. Provisional Patent Appl. No. 62/608,363, filed on Dec. 12, 2017 and U.S. Provisional Patent Appl. No. 62/502,482, filed on May 5, 2017, the contents of all of which are fully incorporated herein by reference.

BACKGROUND

Characteristic time (CT) of a golf club head is a measurement used by the United States Golf Association (USGA) to determine the "spring-like effect" of the face plate on a golf ball. A golf club head having a high CT has increased flexibility and transfers greater energy to a golf ball on impact, compared to a golf club head having a low CT. However, the USGA limits the CT of the face plate of a golf club head.

Face plates or striking surfaces of hollow body style golf club heads generally have structural constraints creating regions of high CT towards the upper, toe end of the face plate, and regions of low CT towards the low and heel end of the face plate. Examples of structural constraints that affect the CT can include the stiffness of the hosel, or the weldline created while coupling the face plate to the club head body. The regions of high CT are generally located further away from structural constraints, while the regions of low CT are generally located in a closer proximity to structural constraints. Regions of high CT can generally be referred to as regions having "inherently high CT," and regions of low CT can generally be referred to as regions having "inherently low CT."

As discussed above, generally regions of inherently high CT exist towards in region extending from the center of the face plate towards the upper toe end of the face plate. Further, regions of inherently low CT exist around the perimeter of the face plate along with a region extending from the geometric center point towards the lower heel end of the club head. Discrepancies in the CT across the face plate can result in inconsistent ball flight characteristics imparted on the ball after impact.

Golf club manufacturers must ensure that all regions on the face plate, including regions having inherently high CT values, remain below the USGA limit. Typically, to ensure the highest CT regions remain at or below the USGA limit, manufacturers increase the thickness of the face plate. However, the thicker face plate also decreases the CT in the regions on the face plate having an inherently low CT. As such, these regions having inherently low CT are decreased further and have a CT well below the USGA limit. The result is a club head having large variation in CT values across the face plate surface, resulting in an inconsistent and/or lower performing club head. Accordingly, there is a need in the art for a golf club head having improved flexibility and consistency, while remaining within USGA conformance limits on characteristic time.

BRIEF DESCRIPTION OF THE DRAWING

The present disclosure will be better understood from a reading of the following detailed description, taken in conjunction with the accompanying drawing figures in which like references designate like elements, and in which.

Figure 1:
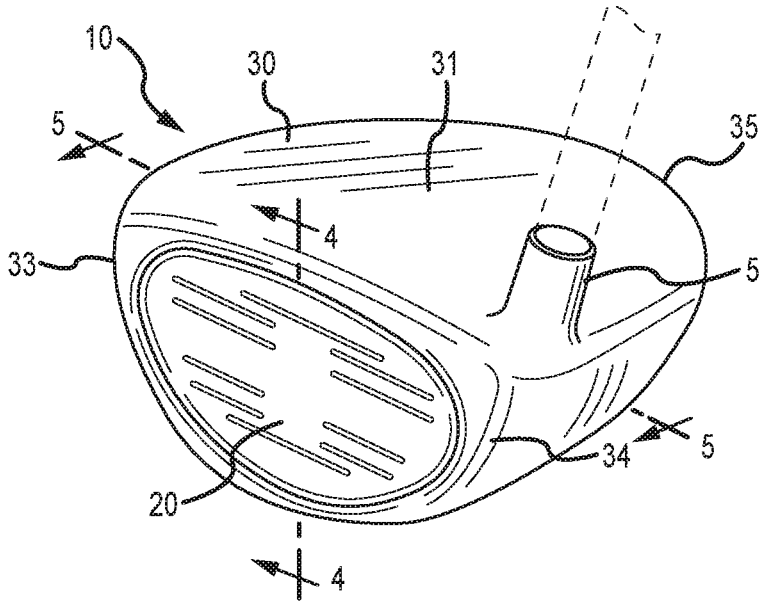
FIG. 1 is perspective view of a golf club head having a variable face thickness, according to one embodiment.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DETAILED DESCRIPTION

Described herein is a hollow body golf club head comprising a face plate having a variable thickness to normalize characteristic time (CT) for different impact locations across the face. In many embodiments, the variable thickness face plate comprises a central region, a transition region, and a peripheral region. The thickened region can comprise an oval, ellipse, or ovoid shape, and can be symmetric about a major axis extending along the length of the thickened region. The thickened region can extend over the geometric center of the face plate and can be positioned such that the major axis is angled or tilted with respect to the ground plane, thereby defining an angled variable face thickness or angled VFT.

The club heads described herein address regions of inherently high and low CT, as described above, by increasing face plate thickness in regions of having inherently high CT to lower the regional CT value, while reducing the face plate thickness in regions having inherently low CT to raise the regional CT value. Accordingly, the club heads described herein have a more consistent and greater overall CT of the face plate, compared to similar club heads devoid of the angled VFT described herein, while remaining within USGA conformance guidelines.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Disclosed herein are exemplary embodiments of a hollow bodied golf club head having normalized characteristic time (CT). The golf club head having normalized CT includes a body and a face plate having a variable thickness profile or variable face thickness (VFT).

The body comprises a crown, a sole, a toe end, a heel end and rear end defining an interior cavity. The body includes an opening into the interior cavity. The opening is configured to receive the face plate. The variable thickness profile of the face plate comprises a central region, a transition region and a peripheral region. In many embodiments, as described below, the central region is thickened, the peripheral region is thinned, and the transition region decreases in thickness from an outer perimeter of the central thickened region to the peripheral region.

In many embodiments, the variable thickness profile or variable face thickness is positioned at an angle relative to a ground plane, generating an angled variable thickness profile or angled VFT. Further, in many embodiments, the variable thickness profile comprises an oval shape positioned such that an area of maximum or increased thickness is greater near the crown and/or toe end than near the heel and/or sole.

The hollow body golf club head can be a driver, a fairway wood, a hybrid or a cross-over type club head. The club head can have a volume in the range of 75 cc to 500 cc. For example, the volume of the golf club head can be in the range of 75 cc to 150 cc, 200 cc to 300 cc, 250 cc to 350 cc, 400 cc to 440 cc, 430 cc to 450 cc, 440 cc to 460 cc, 450 cc to 470 cc, 460 cc to 480 cc, 470 cc to 490 cc, or 480 cc to 500 cc. In other embodiments, the volume of the golf club head can be 75 cc, 100 cc, 150 cc, 200 cc, 250 cc, 300 cc, 350 cc, 400 cc, 440 cc, 445 cc, 450 cc, 455 cc, 460 cc, 465 cc, 470 cc, 475 cc, 480 cc, 485 cc, 490 cc, 495 cc, or 500 cc.

Further, the loft of the club head can be in the range of 5 degrees to 40 degrees. For example, the golf club head can have a loft of 5 degrees to 15 degrees, 10 degrees to 20 degrees, 15 degrees to 25 degrees, 20 degrees to 30 degrees, 25 degrees to 35 degrees, or 30 degrees to 40 degrees. In other embodiments, the golf club head 10 can have a loft of 5 degrees, 6 degrees, 7 degrees, 8 degrees, 9 degrees, 10 degrees, 11 degrees, 12, degrees, 13 degrees, 14 degrees, 15 degrees, 20 degrees, 25 degrees, 30 degrees, 35 degrees, or 40 degrees.

The club head may further include a hosel 5 configured to receive a first end of a shaft (not shown). The shaft may be secured to the golf club head by an adhesive bonding process (e.g., epoxy) and/or other suitable bonding processes (e.g., mechanical bonding, soldering, welding, and/or brazing). Further, a grip (not shown) may be secured to a second end of the shaft (not shown) to form a usable golf club.

I. Golf Club Head Having Normalized CT According to One Embodiment

Referring to FIGS. 1-5, an exemplary embodiment of a golf club head 10 having normalized CT is illustrated. The club head 10 comprises a body 30 and a face plate or strike face 20 having a variable thickness profile or variable face thickness 40. The face plate 20 and the body 30 together form the club head 10 having a hollow interior or void or inner cavity 36.

A. Body

Figure 2:
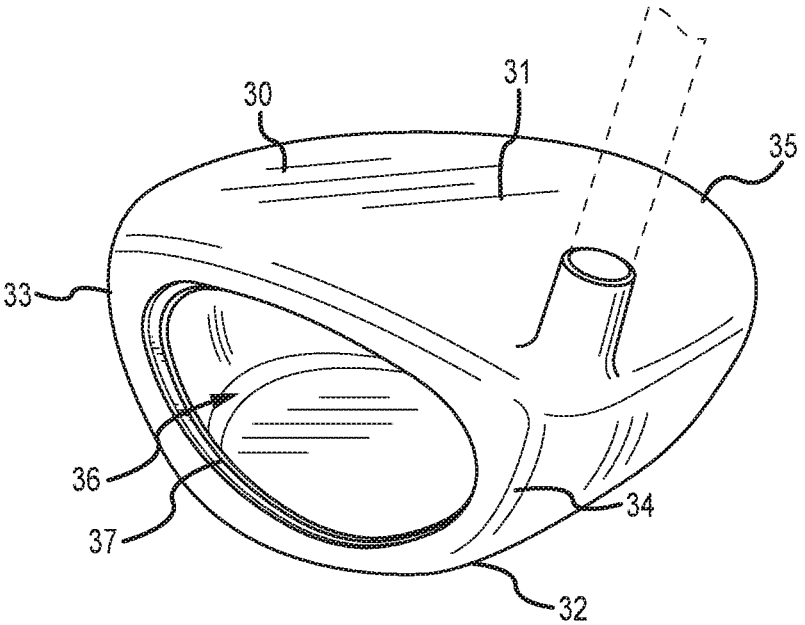
FIG. 2 is a perspective view of the golf club head body of FIG. 1.

Referring to FIG. 2, the body 30 of the club head 10 is displayed. The body 30 comprises a crown portion 31, a sole portion 32, a toe portion 33, a heel portion 34, and a rear portion 35 defining an inner cavity 36. In the illustrated embodiment, the body 30 includes an opening 37 positioned on a forward most portion of the club head 10. The opening 37 is configured to receive the face plate 20. In some embodiments, the opening can be positioned on a front end of the club head and can be configured to receive an insert style face plate. In other embodiments, the opening can be positioned along the crown portion and/or sole portion of the club head and can be configured to receive a cup-face style face plate or a face plate having a return portion or cup-like geometry.

The club head body 30 can comprise a strong, light weight material. For example, the club head body 30 can be formed from stainless steel, titanium, aluminum, steel alloys (e.g. 455 steel, 475 steel, 431 steel, 17-4 stainless steel, maraging steel), titanium alloys (e.g. Ti-7-4, Ti-8-1-1, or Ti-6-4), composite materials such as, for example, plastic polymers, thermoset polymers, thermoplastic polymers, co-polymers, carbon fibers, fiberglass fibers, metal fibers, or any combination thereof.

B. Face Plate Having Variable Thickness Profile

Figure 3:
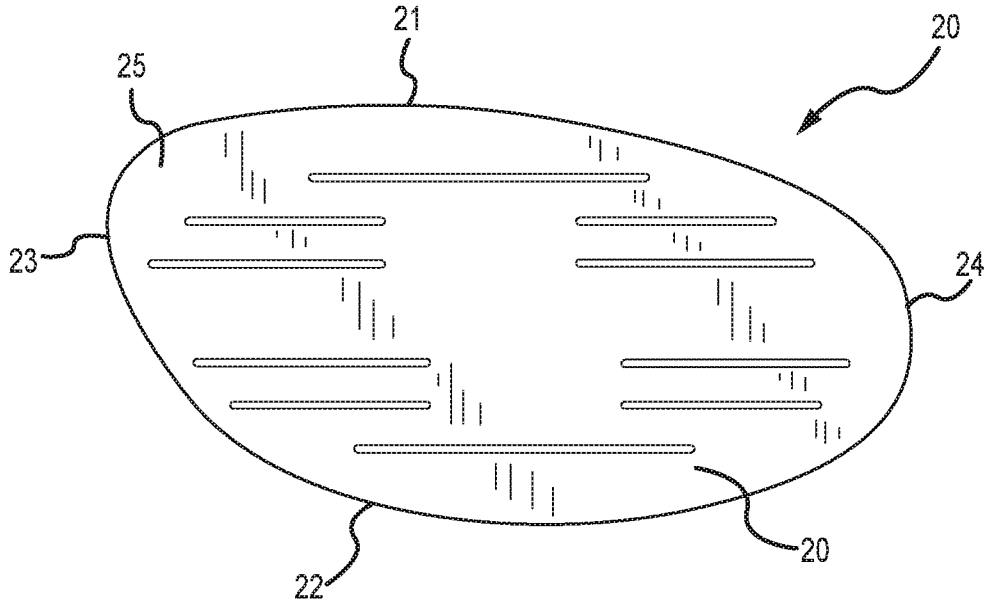
FIG. 3 is a front view of the face plate of the golf club head of FIG. 1.

Referring to FIG. 3, the face plate 20 of the club head 10 is displayed. The face plate 20 comprises a top or top portion 21, a bottom or bottom portion 22, toe or toe portion 23, a heel or heel portion 24, a front surface 25, a rear surface 26, and a variable face thickness (VFT) or variable thickness profile 40. The face plate 20 can be a planar surface or the face plate 20 can have a slight bulge and/or roll curvature.

Figure 4:
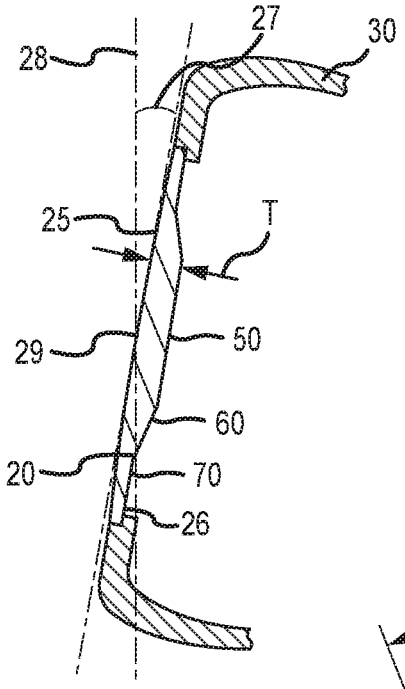
FIG. 4 is a side cross-sectional view of the golf club head of FIG. 1 along line 4-4.

Referring to FIG. 4, a side cross-sectional view taken along the line 4-4 of FIG. 1 is shown. The face plate 20 further includes a loft angle 27, measured as the angle between a loft plane and a vertical plane 28. The loft plane extends through, and is tangent to, a geometric center 29 of the face plate 20. The vertical plane 28 extends through the geometric center 29 of the face plate 20, perpendicular to the ground plane when the club head 10 is held in a neutral or address position.

Figure 5:
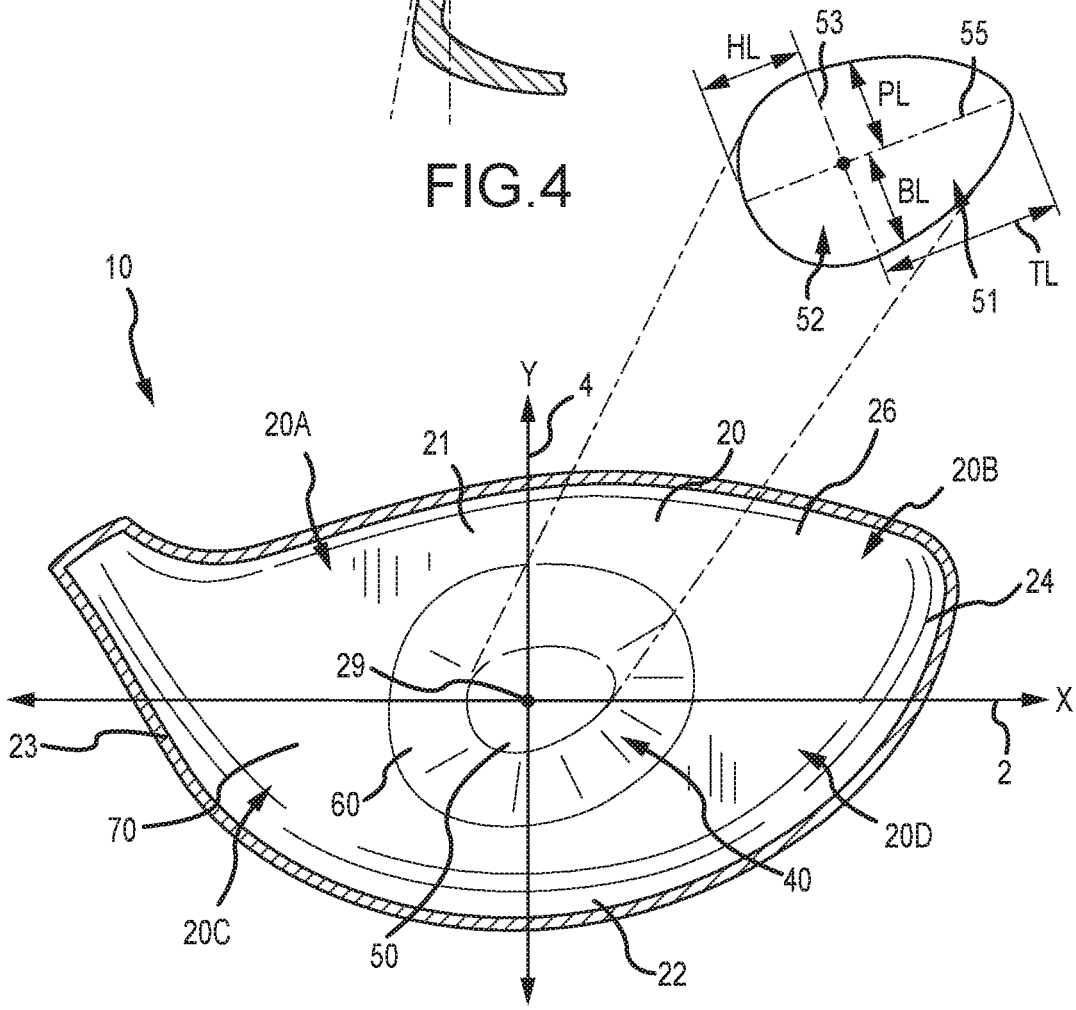
FIG. 5 is a rear cross-sectional view of the golf club head of FIG. 1 along line 5-5.

Further referring to FIG. 5, the geometric center 29 of the face plate 20 can be located at a geometric midpoint of the face plate 20. In the same or other examples, the geometric center 29 also can be centered with respect to an engineered impact zone, which can be defined by a region of grooves of the face plate 20. As another approach, the geometric center 29 of the face plate 20 can be located in accordance with the definition of a golf governing body such as the United States Golf Association (USGA). For example, geometric center 29 of the face plate 20 can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure")

The geometric center 29 of the face plate 20 defines an origin of a coordinate system having an x-axis or horizontal axis 2, and a y-axis or vertical axis 4. The x-axis 2 extends horizontally through the geometric center 29 of the face plate 20 from near the heel portion 35 to near the toe portion 33 of the club head 10 in a direction parallel to a ground plane when the club head 10 is at an address position. The y-axis 4 extends vertically through the geometric center 29 of the face plate 20 from near the crown portion 31 to near the sole portion 32 of the club head 10 in a direction perpendicular to the x-axis and to the ground plane when the club head 10 is at an address position.

In some embodiments, the face plate or strike face 20 may be formed separately from the body 30 and subsequently coupled to the body 30 to form the hollow body club head 10. In these or other embodiments, the face plate or strike face 20 may be coupled to the body 30 via a weld bond, a brazed bond, a co-molded bond, an adhesive bond, a mechanical fastener, or any other suitable attachment method.

The face plate 20 can comprise a strong, light weight material. For example, the club head body 30 can be formed from stainless steel, titanium, aluminum, steel alloys (e.g. 455 steel, 475 steel, 431 steel, 17-4 stainless steel, maraging steel), titanium alloys (e.g. Ti-7-4, Ti-8-1-1, or Ti-6-4), composite materials such as, for example, plastic polymers, thermoset polymers, thermoplastic polymers, co-polymers, carbon fibers, fiberglass fibers, metal fibers, or any combination thereof. The face plate 20 can comprise the same material as, or a different material than the body 30.

Referring to FIGS. 4 and 5, the face plate 20 of the club head 10 comprises a thickness T measured as the distance between a front surface 25 and a rear surface 26. The thickness T of the face plate 20 varies at different locations across defining a variable face thickness (VFT) or variable thickness profile 40. The variable thickness profile 40 of the face plate 20 comprises a central region 50, a transition region 60, and a peripheral region 70 formed by the variation in thickness of the face plate 20.

Referring to FIGS. 4 and 5, the central region 50 extends over or is positioned on or near the geometric center 29 of the face plate 20, such that the geometric center 29 of the face plate 20 is located in the central region 50. The central region 50 comprises a maximum thickness of the face plate 20. In many embodiments, the thickness of the central region 50 is substantially constant. Further, the peripheral region 70 is positioned around the perimeter of the face plate and comprises a minimum thickness of the face plate 20. In many embodiments, the thickness of the peripheral region 70 is substantially constant. The thickness of the face plate 20 in the central region 50 is greater than the thickness of the face plate 20 in the peripheral region 70. Further, in many embodiments, the transition region 60 includes a varying thickness that creates a smooth transition between the central region 50 and the peripheral region 60. In the illustrated embodiment, the thickness of the face plate 20 in the transition region 60 tapers between the maximum face plate thickness in the central region 50 and the minimum face plate thickness in the peripheral region. In other embodiments, the thickness of the face plate 20 in the transition region can vary according to any profile including straight and/or curved geometries.

i. Central Region

In the illustrated embodiment, the central region 50 of the variable thickness profile 40 comprises an ellipse, oval (or ovoid), or egg-like shape. The central region 50 is generally oblong and extends from a portion of the face plate 20 near the bottom 22 and heel 24 to a portion of the face plate 20 near the toe 23 and top 21. In other embodiments, the central region 50 can comprise any other shape having a single axis of symmetry. The shape of the central region 50 defines a major axis 55 extending in a general heel 23 to toe 24 direction and a minor axis 53 extending generally in a top 21 to bottom 22 direction. The major axis 55 and the minor axis 53 intersect at a center of the central region 50. The major axis 55 extends along a length of the central region 50, and the minor axis 53 extends along a maximum width of the central region 50.

In the illustrated embodiment of FIGS. 4 and 5, the central region 50 of the variable thickness profile 40 is symmetric about a single axis. In the illustrated embodiment, the central region 50 is symmetric about the major axis 55, and is not symmetric about the minor axis 53. Accordingly, the width of the central region 50 varies along the length of the central region 50 from the heel 24 to the toe 23. In the illustrated embodiment, the width of the central region 50 is greater near the heel 24 than near the toe 23, when measured at locations equidistant from the minor axis 53. By way of non-limiting example, the width of the central region measured 0.25 inch from the minor axis 53 toward the heel 24 is greater than the width of the central region 50 measured 0.25 inch from the minor axis 53 toward the toe 23.

In the illustrated embodiment of FIGS. 4 and 5, the center of the central region 50 corresponds to the geometric center 29 of the face plate 20. In other embodiments, the center of the central region 50 can be in a different location than the geometric center 29 of the face plate 20. In the illustrated embodiment, the central region 50 is symmetric about an axis that passes through the geometric center 29. In other embodiments, the central region 50 can be asymmetrical over any axis passing through the geometric center 29 of the face plate 20.

The central region 50 comprises a first side or toe side 51 and a second side or heel side 52. The first side 51 and second side 52 of the central region 50 are separated by the minor axis 53. The first side is positioned between the minor axis 53 and the toe portion 23, and the second side is positioned between the minor axis 53 and the heel portion 24. The first side 51 can be formed by a portion of (or by half of) a first ellipse, and the second side 52 of the central region 50 can be formed by a portion of (or by half of) a second ellipse. The length of the first ellipse, measured along the major axis 55, is greater than the length of the second ellipse.

In many embodiments, the central region 50 of the variable thickness profile 40 of the club head 10 comprises a ratio measured as the surface area of the first side 51 to the surface area of the second side 52 between 1.2 and 2.0. In some embodiments, the ratio of the surface area of the first side 51 to the surface area of the second side 52 of the central region 50 is greater than 1.0, greater than 1.1, greater than 1.2, greater than 1.3, greater than 1.4, greater than 1.5 greater than 1.6, greater than 1.7, greater than 1.8, greater than 1.9, greater than 2.0, or greater than 2.5. For example, in some embodiments, the ratio of the surface area of the first side 51 to the surface area of the second side 52 of the central region 50 can be between 1.0 and 2.0, between 1.1 and 2.0, between 1.2 and 2.0, between 1.3 and 2.0, between 1.4 and 2.0, or between 1.5 and 2.5.

In the illustrated embodiment, the central region 50 comprises a toe-side length TL, a heel-side length HL, a top-side length PL, and a bottom-side length BL. The toe-side length TL is measured along the major axis 55 from the center of the central region 50 toward the toe 23. The heel-side length HL is measured along the major axis 55 from the center of the central region 50 toward the heel 24. The top-side length PL is measured along the minor axis 53 from the center of the central region 50 toward the top 21. The bottom-side length BL is measured along the minor axis 52 from the center of the central region 50 toward the bottom 22.

In the illustrated embodiment, the top-side length PL and the bottom side length BL are 0.285 inches. In other embodiments, the top-side length PL and/or the bottom side length BL can be between 0.05 and 1.0 inches. For example, in some embodiments, the top-side length PL and/or the bottom side length BL can be between 0.05 and 0.25, 0.15 and 0.35, 0.25 and 0.45, 0.35 and 0.55, 0.45 and 0.65, 0.55 and 0.75, 0.65 and 0.85, or 0.75 and 0.1 inches. In the illustrated embodiment, the top-side length PL and the bottom-side length BL are the same. In other embodiments, the top-side length PL can be greater than the bottom-side length BL, or the bottom-side length BL can be greater than the top-side length PL.

In the illustrated embodiment, the toe-side length TL is 0.546 inches, and the heel-side length HL is 0.312 inches. In other embodiments, the toe-side length TL can range from 0.2 to 1.5 inches. For example, in some embodiments, the toe-side length TL can range from 0.2 to 0.4, 0.3 to 0.5, 0.4 to 0.6, 0.5 to 0.7, 0.6 to 0.8, 0.7 to 0.9, 0.8 to 1.0, 0.9 to 1.1, 1.0 to 1.2, 1.1 to 1.3, 1.2 to 1.4, or 1.3 to 1.5 inches. Further, in other embodiments, the heel-side length HL can range from 0.1 to 0.7 inches. For example, in some embodiments, the heel-side length HL can range from 0.1 to 0.3, 0.2 to 0.4, 0.3 to 0.5, 0.4 to 0.6, or 0.5 to 0.7 inches. The toe-side length is greater than the heel-side length. The difference in between the toe-side length TL and the heel-side length HL generates or forms the ovoid, ellipsoidal, or egg-shaped contour displayed in FIG. 5 and enables normalization of CT across the face plate 20.

In the illustrated embodiment, the central region 50 has a thickness of 0.135. In other embodiments, the thickness of the central region 50 can vary from 0.070 to 0.25 inches. For example, in some embodiments, the thickness of the central region 50 can be from 0.07 to 0.1, 0.09 to 0.1, 0.095 to 0.105, 0.1 to 0.12, 0.105 to 0.115, 0.11 to 0.12, 0.115 to 0.125, 0.12 to 0.13, 0.125 to 0.135, 0.13 to 0.14, 0.135 to 0.145, 0.14 to 0.15, 0.145 to 0.155, 0.15 to 0.17, 0.16 to 0.18, 0.17 to 0.2, 0.19 to 0.22, or 0.21 to 0.25 inches. Further, in the illustrated embodiment, the central region 50 comprises 6% of the total surface area of the face plate 20. In other embodiments, the central region 50 can comprise less than 5%, less than 10%, less than 15%, less than 20%, less than 25%, or less than 30% of the total surface area of the face plate 20. For example, the central region 50 can comprise 2-10%, 5-10%, 2-15%, 5-15%, or 5-20% of the total surface area of the face plate 20.

In many embodiments, the central region 50 is disposed at an angle on the rear surface 26 of the face plate 20 of the club head 10. Specifically, the major axis 55 of the central thickened region 50 is disposed at an angle with respect to the x-axis 2. The angle can be configured such that the first side 51 or long portion of the central region 50 extends from the geometric center 29 of the face plate 20 towards the upper-toe portion of the face plate 20, wherein the regions of inherently high CT exist.

In the illustrated embodiment, the minor axis 53 of the central region 50 forms an angle of 20 degrees with the y-axis 4. In other embodiments, the minor axis 53 of the central region 50 can form an angle of 2 to 60 degrees with the y-axis 4. For example, in some embodiments, the minor axis 53 of the central region 50 and the y-axis 4 can create an angle between 2 to 20, 2 to 30, 5 to 40, 10 to 50, or 15 to 60 degrees. In other embodiments, the minor axis 52 of the central thickened region 50 can create an angle of 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, or 60 degrees with the y-axis 4.

Further, in the illustrated embodiment, the major axis 55 of the central region 50 forms an angle of 20 degrees with the x-axis 2. In general, the angle formed between the major axis of the central region 50 and the x-axis 2 is the same as the angle formed between the minor axis 53 of the central region 50 and the y-axis 54. For example, the angle formed between the major axis 55 of the central region 50 and the x-axis 2 can vary from 0 to 60 degrees. In some embodiments, the angle formed between the major axis 55 of the central region 50 and the x-axis 2 can vary from 2 to 20, 2 to 30, 5 to 40, 10 to 50, or 15 to 60 degrees. In other embodiments, the major axis 55 of the central region 50 can create an angle of 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, or 60 degrees with the x-axis 2. By disposing the central thickened region 50 on an angle it further allows the elongated portion of the egg-shape to extend towards the upper-toe portion if the face plate 20 wherein high CT values exist.

Figure 11:
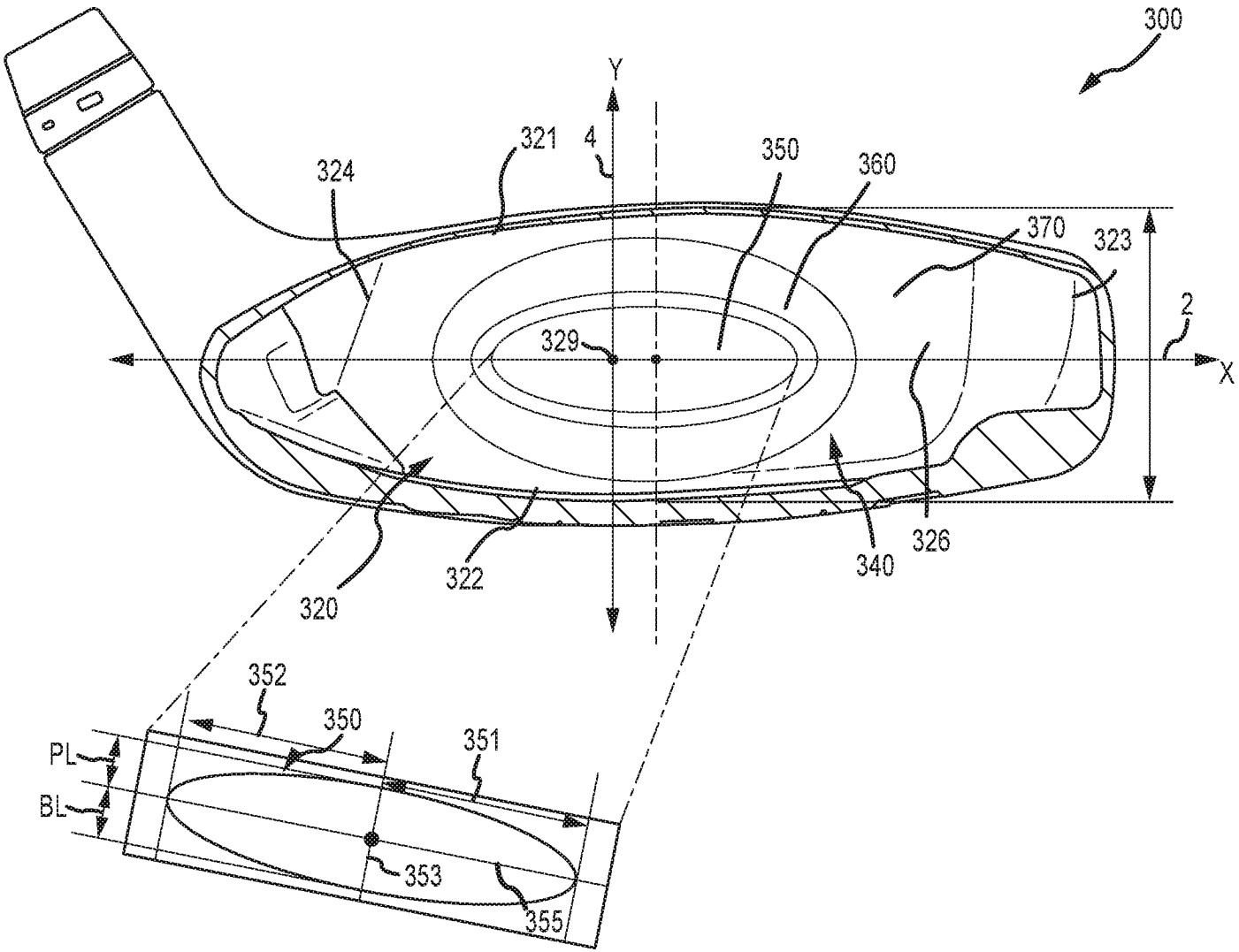
FIG. 11 is a rear cross-sectional view of an exemplary golf club head according to another embodiment.

Further, illustrated in FIG. 11, the central region 50 can be shifted from the y-axis 4, towards the toe portion 33 of the golf club head 10. In most embodiments, the central region 50 is shifted toward the toe portion 33 by at least 0.05 inches, by at least 0.10 inches, by at least 0.15 inches, by at least 0.20 inches, by at least 0.25 inches, or by at least 0.30 inches. In some embodiments, the central region 50 is shifted toward the toe portion 33 by 0.05 inches, 0.06 inches, 0.07 inches, 0.08 inches, 0.09 inches, 0.10 inches, 0.11 inches, 0.12 inches, 0.13 inches, 0.14 inches, 0.15 inches, 0.16 inches, 0.17 inches, 0.18 inches, 0.19 inches, 0.20 inches, 0.21 inches, 0.22 inches, 0.23 inches, 0.24 inches, 0.25 inches, 0.26 inches, 0.27 inches, 0.28 inches, 0.29 inches, or 0.30 inches.

ii. Transition Region

Referring to FIGS. 4 and 5, the transition region 60 of the variable face thickness 40 extends from the perimeter of the central thickened region 50 to the peripheral region 70. In the illustrated embodiment, the transition region 60 gradually tapers from a thickest portion near the perimeter of central thickened region 50 towards a thinnest region near or adjacent to the peripheral region 70. The thickest region of the transition region 60 can be equal to or slightly less than the thickness of the central thickened region 50, while the thinnest region of the transition region 60 can be equal to, or slightly greater than the peripheral region 70.

In many embodiments, the transition region 60 can comprise a shape similar to or corresponding to the shape of the central region 50. In the illustrated embodiment, the transition region 60 extends a constant or fixed distance of 0.45 inches from the perimeter of the central thickened region 50 to the peripheral region 70. In other embodiments, the transition region can extend from 0.15 to 0.75 inches from the perimeter of the central thickened region 50 to the peripheral region 70. For example, in some embodiments, the transition region 60 can extend between 0.15 to 0.35, 0.25 to 0.45, 0.35 to 0.55, 0.45 to 0.65, or 0.55 to 0.75 inches from the perimeter of the central thickened region 50 to the peripheral region 70. In yet another embodiment, the distance the transition region 60 extends from the perimeter of the central thickened region 50 can vary. For example, the length of the transition region 60 extending towards the top portion 21 of the face plate 20 can be greater or less than the length of the transition region 60 extending towards the bottom portion 22 of the face plate 20. In other embodiments, the length of the transition region 60 extending in any direction from the central thickened region 60 can be greater than, less than or the same as the length of the transition region 60 extending in any other direction from the central thickened region.

Further, in the illustrated embodiment, the transition region 60 comprises 27% of the total surface area of the face plate 20. In other embodiments, the transition region 60 can comprise between 10% and 70% of the total surface area of the face plate 20. For example, in some embodiments, the transition region 60 can comprise between 10% to 30%, 20% to 40%, 30% to 50%, 40% to 60%, or 50% to 70% of the total surface area of the face plate 20.

iii. Peripheral Region

Referring again to FIGS. 4 and 5, the peripheral region 70 of the variable thickness profile 40 extends from the perimeter of the transition region 60 to the perimeter of the face plate 20. In the illustrated embodiment, the thickness of the peripheral region 70 is 0.85 inches. In other embodiments, the thickness of the peripheral region 70 can be less than 0.15 inches. For example, in some embodiments, the peripheral region 70 can be less than 0.15 inches, less than 0.1 inches, less than 0.09 inches, less than 0.08 inches, less than 0.07 inches, less than 0.06 inches, less than 0.05 inches, or less than 0.04 inches.

Further, in the illustrated embodiment, the peripheral region 70 comprises 67% of the total surface area of the face plate 20. In other embodiments, the peripheral region 70 can comprise 30% to 90% of the total surface area of the face plate 20. For example, in some embodiments, the peripheral region 70 can comprise between 30% to 50%, 40% to 60%, 50% to 70%, 60% to 80%, or 70% to 90% of the total surface area of the face plate 20.

iii. Variable Thickness Profile Relative to Face Plate Quadrants

Referring to FIG. 5, the face plate 20 can comprise four quadrants, including: an upper heel-side quadrant 20A, an upper toe-side quadrant 20B, a lower heel-side quadrant 20C, and a lower toe-side quadrant 20D. The upper heel-side quadrant 20A extends heel-ward (toward the heel) from the y-axis 4 and crown ward (toward the crown) from x-axis 2 to the outer periphery of the face plate 20. The upper toe-side quadrant 20B extends toe ward (toward the toe) from the y-axis 4 and crown-ward (toward the crown) from the x-axis 2 to the outer periphery of the face plate 20. The lower heel-side quadrant 20C extends heel-ward (toward the heel) from the y-axis 4 and sole ward (toward the sole) from x-axis 2 to the outer periphery of the face plate 20. The lower toe-side quadrant 20D extends toe-ward from the y-axis 4 and sole-ward from x-axis 2 to the outer periphery of the face plate 20.

The central region 50 can extend at least partially into all four quadrants of the face plate 20A, 20B, 20C, 20D. Each quadrant of the face plate 20 can comprise different portions or percentages of the total surface area of the central region 50. In many embodiments, a greater percentage of the total surface area of the central region 50 is located in the upper toe-side quadrant 20B than in one or more of the lower heel-side quadrant 20C, the upper heel-side quadrant 20A, and the lower toe-side quadrant 20D. Further, in many embodiments, the lower heel-side quadrant 20C comprises a lower percentage of the total surface area of the central region 50 than one or more of the upper toe-side quadrant 20B, the upper heel-side quadrant 20A, and the lower toe-side quadrant 20D. In some embodiments, surface area of the central thickened region 50 within the upper heel-side quadrant 20A can be the same as or similar to the surface area of the central thickened region 50 within the lower toe-side quadrant 20D.

In the illustrated embodiment, the upper toe-side quadrant 20B comprises 38% of the total surface area of the central region 50, the lower heel-side quadrant 20C comprises 19% of the total surface area of the central region 50, the lower toe-side quadrant comprises 25% of the total surface area of the central region 50, and the upper heel-side quadrant 20A comprises 18% of the total surface area of the central region 50.

In many embodiments, the upper toe-side quadrant 20B can comprise greater than 25%, greater than 30%, greater than 35%, greater than 40%, greater than 45%, or greater than 50% of the total surface area of the central region 50. For example, in some embodiments, the upper toe-side quadrant 20B can comprise 30-50% of the total surface area of the central region 50. Further, in many embodiments, the lower heel-side quadrant 20C can comprise less than 30%, less than 25%, less than 20%, less than 15%, less than 10%, or less than 5% of the total surface area of the central region 50. For example, in some embodiments, the lower heel-side quadrant 20C can comprise 5-20% of the total surface area of the central region 50. Further still, in many embodiments, the lower toe-side quadrant 20D and/or the upper heel-side quadrant 20A can comprise between 15-30% of the total surface area of the central region 50.

The transition region 60 can extend at least partially into all four quadrants of the face plate 20A, 20B, 20C, 20D. Each quadrant of the face plate 20 can comprise different portions or percentages of the total surface area of the transition region 60. In many embodiments, a greater percentage of the surface area of the transition region 60 is located in the upper toe-side quadrant 20B than in one or more of the lower heel-side quadrant 20C, the upper heel-side quadrant 20A, and the lower toe-side quadrant 20D. Further, in many embodiments, the lower heel-side quadrant 20C comprises a lower percentage of the total surface area of the transition region 60 than one or more of the upper toe-side quadrant 20B, the upper heel-side quadrant 20A, and the lower toe-side quadrant 20D. In some embodiments, surface area of the transition region 60 within the upper heel-side quadrant 20A can be the same as or similar to the surface area of the transition region 60 within the lower toe-side quadrant 20D.

In many embodiments, the upper toe-side quadrant 20B can comprise greater than 25%, greater than 30%, greater than 35%, greater than 40%, greater than 45%, or greater than 50% of the total surface area of the transition region 60. For example, in some embodiments, the upper toe-side quadrant 20B can comprise 30-50% of the total surface area of the transition region 60. Further, in many embodiments, the lower heel-side quadrant 20C can comprise less than 30%, less than 25%, less than 20%, less than 15%, less than 10%, or less than 5% of the total surface area of the transition region 60. For example, in some embodiments, the lower heel-side quadrant 20C can comprise 5-20% of the total surface area of the transition region 60. Further still, in many embodiments, the lower toe-side quadrant 20D and/or the upper heel-side quadrant 20A can comprise between 15-30% of the total surface area of the transition region 60.

iv. Benefits of Variable Thickness Profile

The oval or ovoid or ellipsoidal or egg-like shape, along with the angle of the central region 50 of the variable thickness profile 40, enables thicker regions of the face plate 20 to be positioned in regions having inherently high CT, and thinner regions of the face plate 20 to be positioned in regions having inherently low CT. Accordingly, regions of the face having inherently high CT are reduced, and regions of the face having inherently low CT are increased, resulting in normalized CT across the face plate 20. In many embodiments, the variable thickness profile 40 results in a range in characteristic time less than 115 seconds, less than 110 seconds, less than 105 seconds, less than 100 seconds, less than 95 seconds, less than 90 seconds, or less than 85 seconds. Further, in many embodiments, the variable thickness profile 40 results in an average characteristic time greater than 230 seconds, greater than 235 seconds, or greater than 240 seconds. For example, in many embodiments, the average CT of the face plate 20 can be between 230 seconds and 240 seconds, between 235 seconds and 240 seconds, or between 240 seconds and 245 seconds.

Further, because the angled VFT is designed to position thickened portions of the face plate 20 in regions where it is required, the face plate can experience a weight reduction compared to a face plate devoid of the variable thickness profile 40 described herein. The extra discretionary weight can be re-introduced in other regions of the club head to manipulate the club head center of gravity position and to increase club head moment of inertia, further improving the performance of the club head. In the illustrated embodiment, the club head 10 having the variable thickness profile 40, as described herein, saves 2.1 grams of weight compared to a similar club head devoid of the variable thickness profile 40.

II. Golf Club Head Having Normalized CT According to Another Embodiment

Figure 6:
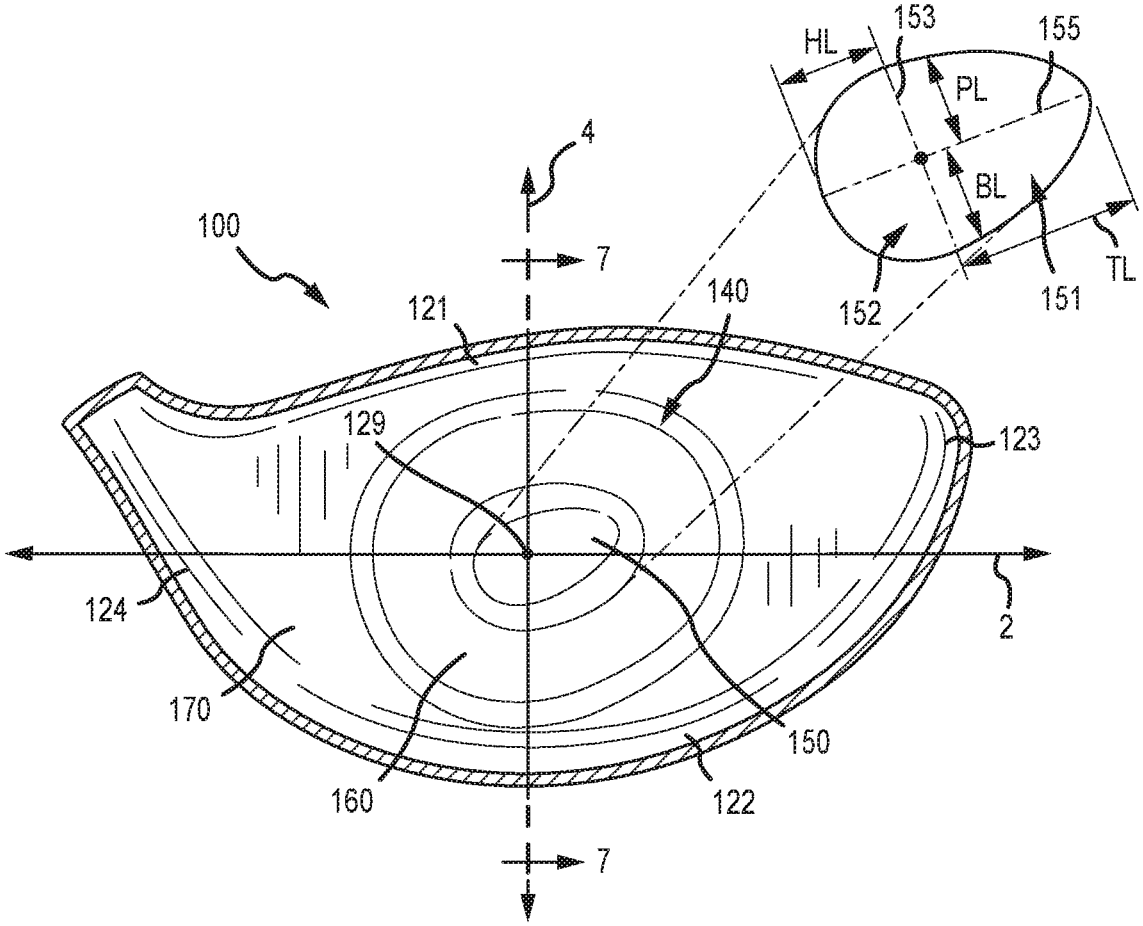
FIG. 6 is a rear cross-sectional view of another embodiment of a golf club head having a variable face thickness.
Figure 7:
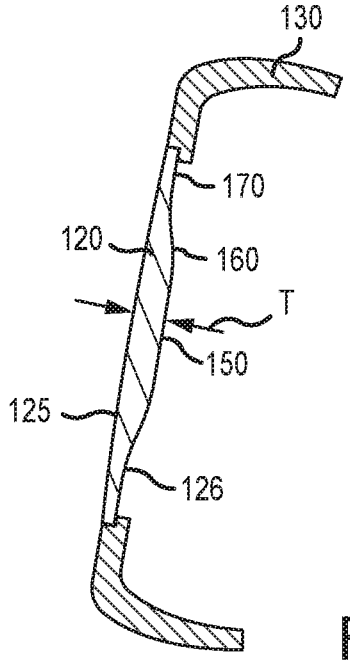
FIG. 7 is a side cross-sectional view of the golf club head of FIG. 6.
Figure 8:
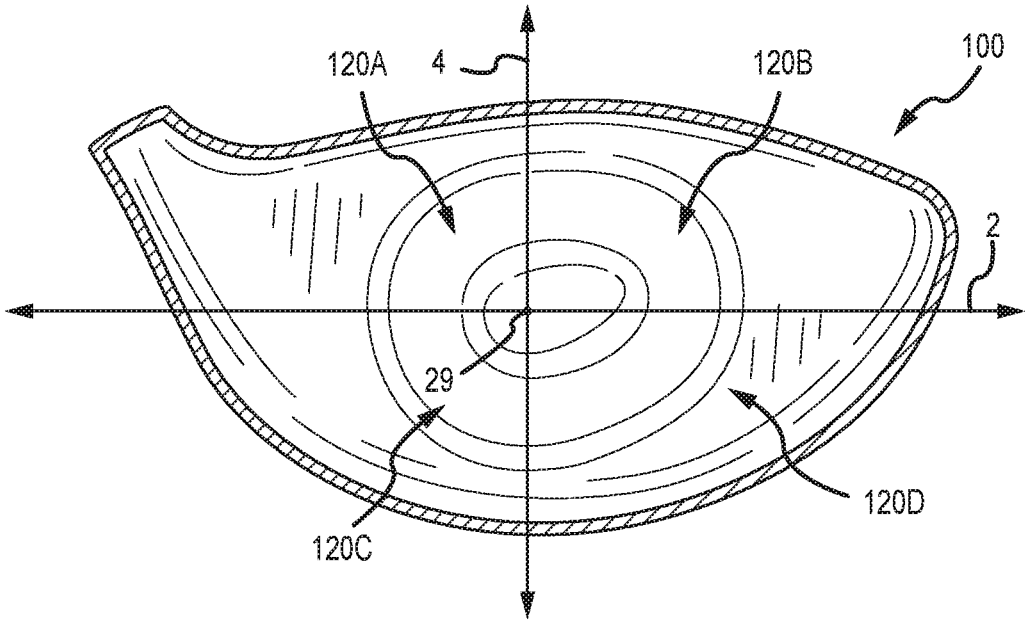
FIG. 8 is a rear cross-sectional view of an exemplary golf club head according to the embodiment of FIG. 6.

Referring to FIGS. 6 and 7, another embodiment of a golf club head 100 having a normalized CT is illustrated. The club head 100 comprises a body 130 and a face plate or strike face 120 having a variable thickness profile or variable face thickness 140. The face plate 120 and the body 130 together form the club head 100 having a hollow interior or void or inner cavity. In many embodiments, the club head 100 can be similar or identical to club head 10, and the body 130 can be similar or identical to body 30, and the face plate 120 can be similar to face plate 20, as described below with like numbers referencing like components.

A. Body

The body 130 comprises a crown portion 131, sole portion, 132, toe portion 133, heel portion 134, and a rear portion 135 defining an inner cavity. In the illustrated embodiment, the body 130 includes an opening positioned on a forward most portion of the club head 100. The opening is configured to receive the face plate 120. In some embodiments, the opening can be positioned on a front end of the club head and can be configured to receive an insert style face plate. In other embodiments, the opening can be positioned along the crown portion and/or sole portion of the club head and can be configured to receive a cup-face style face plate or a face plate having a return portion or cup-like geometry.

The club head body 130 can comprise a strong, light weight material. For example, the club head body 130 can be formed from stainless steel, titanium, aluminum, steel alloys (e.g. 455 steel, 475 steel, 431 steel, 17-4 stainless steel, maraging steel), titanium alloys (e.g. Ti-7-4, Ti-8-1-1, or Ti-6-4), composite materials such as, for example, plastic polymers, thermoset polymers, thermoplastic polymers, copolymers, carbon fibers, fiberglass fibers, metal fibers, or any combination thereof.

B. Face Plate Having Variable Thickness Profile

The face plate 120 comprises a top or top portion 121, a bottom or bottom portion 122, toe or toe portion 123, a heel or heel portion 124, a front surface 125, a rear surface 126, and a variable face thickness (VFT) or variable thickness profile 140. The face plate 120 can be a planar surface or the face plate 120 can have a slight bulge and/or roll curvature.

Referring to FIG. 7, a side cross-sectional view taken along the line 7-7 of FIG. 6 is shown. The face plate 120 includes a loft angle, measured as the angle between a loft plane and a vertical plane. The loft plane extends through, and is tangent to, a geometric center 129 of the face plate 120. The vertical plane extends through the geometric center 128 of the face plate 120, perpendicular to the ground plane when the club head 100 is held in a neutral or address position.

Further referring to FIG. 6, the face plate 120 the geometric center 129 of the face plate 120 can be located at a geometric midpoint of the face plate 120. In the same or other examples, the geometric center 129 also can be centered with respect to an engineered impact zone, which can be defined by a region of grooves of the face plate 120. As another approach, the geometric center 129 of the face plate 120 can be located in accordance with the definition of a golf governing body such as the United States Golf Association (USGA). For example, geometric center 129 of the face plate 120 can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure")

The geometric center 129 of the face plate 120 defines an origin of a coordinate system having an x-axis or horizontal axis 2, and a y-axis or vertical axis 4. The x-axis 2 extends horizontally through the geometric center 129 of the face plate 120 from near the heel portion to near the toe portion of the club head 100 in a direction parallel to a ground plane when the club head 100 is at an address position. The y-axis 4 extends vertically through the geometric center 129 of the face plate 120 from near the crown portion to near the sole portion of the club head 100 in a direction perpendicular to the x-axis and to the ground plane when the club head is at an address position.

In some embodiments, the face plate or strike face 120 may be formed separately from the body 130 and subsequently coupled to the body 130 to form the hollow body club head 100. In these or other embodiments, the face plate or strike face 120 may be coupled to the body 130 via a weld bond, a brazed bond, a co-molded bond, an adhesive bond, a mechanical fastener, or any other suitable attachment method.

The face plate 120 can comprise a strong, light weight material. For example, the club head body 130 can be formed from stainless steel, titanium, aluminum, steel alloys (e.g. 455 steel, 475 steel, 431 steel, 17-4 stainless steel, maraging steel), titanium alloys (e.g. Ti-7-4, Ti-8-1-1, or Ti-6-4), composite materials such as, for example, plastic polymers, thermoset polymers, thermoplastic polymers, co-polymers, carbon fibers, fiberglass fibers, metal fibers, or any combination thereof. The face plate 120 can comprise the same material as, or a different material than the body 130.

Referring to FIGS. 6 and 7, the face plate 120 of the club head 100 comprises a thickness T measured as the distance between a front surface 125 and a rear surface 126. The thickness T of the face plate 120 varies at different locations defining a variable face thickness (VFT) or variable thickness profile 140. The variable thickness profile 140 having a central region 150, a transition region 160, and a perimeter region 170. The face plate 120 of the club head 100 can be similar or identical to the face plate 20 of club head 10, except the transition region 160 of the club head 100 can comprise a different profile or contour. In many embodiments, the central region 150 of the club head 100 is similar or identical to the central region 50 of club head 10, and the peripheral region 170 of the club head is similar or identical to the peripheral region 70 of club head 10.

Referring to FIGS. 6 and 7, the central region 150 extends over or is positioned on or near the geometric center 129 of the face plate 120 such that the geometric center 129 of the face plate 120 is located in the central region 150. The central region 150 comprises a maximum thickness of the face plate 120. In many embodiments, the thickness of the central region 150 is substantially constant. The peripheral region 170 is positioned around the perimeter of the face plate and comprises a minimum thickness of the face plate 120. In many embodiments, the thickness of the peripheral region 170 is substantially constant. The thickness of the face plate 120 in the central region 150 is greater than the thickness of the face plate 120 in the peripheral region 170. The transition region 160 includes a varying thickness that creates a transition between the central region 150 and the peripheral region 160.

i. Central Region

In the illustrated embodiment, the central region 150 of the variable thickness profile 140 comprises an ellipse or oval or ovoid or egg-like shape. The central region 150 is generally oblong and extends from a portion of the face plate 120 near the bottom 122 and heel 124 to a portion of the face plate 120 near the toe 123 and top 121. In other embodiments, the central region 150 can comprise any other shape having a single axis of symmetry. The shape of the central region 150 defines a major axis 155 extending in a general heel 123 to toe 124 direction and a minor axis 153 extending generally in a top 121 to bottom 122 direction. The major axis 155 and the minor axis 153 intersect at a center of the central region 150. The major axis 155 extends along a length of the central region 150, and the minor axis 153 extends along a maximum width of the central region 150.

In the illustrated embodiment of FIGS. 6 and 7, the central region 150 of the variable thickness profile 140 is symmetric about a single axis. In the illustrated embodiment, the central region 150 is symmetric about the major axis 155, and is not symmetric about the minor axis 153. Accordingly, the width of the central region 150 varies along the length of the central region 150 from the heel 124 to the toe 123. In the illustrated embodiment, the width of the central region 150 is greater near the heel 124 than near the toe 123, when measured at locations equidistant from the minor axis 153. By way of non-limiting example, the width of the central region measured 0.25 inch from the minor axis 153 toward the heel 124 is greater than the width of the central region 150 measured 0.25 inch from the minor axis 153 toward the toe 123.

In the illustrated embodiment of FIGS. 6 and 7, the center of the central region 150 corresponds to the geometric center 129 of the face plate 120. In other embodiments, the center of the central region 150 can be in a different location than the geometric center 129 of the face plate 120. In the illustrated embodiment, the central region 150 is symmetric about an axis that passes through the geometric center 129. In other embodiments, the central region 150 can be asymmetrical over any axis passing through the geometric center 129 of the face plate 120.

The central region 150 comprises a first side or toe side 151 and a second side or heel side 152. The first side 151 and second side 152 of the central region 150 are separated by the minor axis 153. The first side is positioned between the minor axis 153 and the toe portion 123, and the second side is positioned between the minor axis 153 and the heel portion 124. The first side 151 can be formed by a portion of (or by half of) a first ellipse, and the second side 152 of the central region 150 can be formed by a portion of (or by half of) a second ellipse. The length of the first ellipse, measured along the major axis 155, is greater than the length of the second ellipse.

In many embodiments, the central region 150 of the variable thickness profile 140 of the club head 100 comprises a ratio measured as the surface area of the first side 151 to the surface area of the second side 152 between 1.2 and 2.0. In some embodiments, the ratio of the surface area of the first side 151 to the surface area of the second side 152 of the central region 150 is greater than 1.0, greater than 1.1, greater than 1.2, greater than 1.3, greater than 1.4, greater than 1.5 greater than 1.6, greater than 1.7, greater than 1.8, greater than 1.9, greater than 2.0, or greater than 2.5. For example, in some embodiments, the ratio of the surface area of the first side 51 to the surface area of the second side 152 of the central region 150 can be between 1.0 and 2.0, between 1.1 and 2.0, between 1.2 and 2.0, between 1.3 and 2.0, between 1.4 and 2.0, or between 1.5 and 2.5.

In the illustrated embodiment, the central region 150 comprises a toe-side length TL, a heel-side length HL, a top-side length PL, and a bottom-side length BL. The toe-side length TL is measured along the major axis 55 from the center of the central region 150 toward the toe 123. The heel-side length HL is measured along the major axis 155 from the center of the central region 150 toward the heel 124. The top-side length PL is measured along the minor axis 153 from the center of the central region 150 toward the top 121. The bottom-side length BL is measured along the minor axis 152 from the center of the central region 150 toward the bottom 122.

In the illustrated embodiment, the top-side length PL and the bottom side length BL are 0.285 inches. In other embodiments, the top-side length PL and/or the bottom side length BL can be between 0.05 and 1.0 inches. For example, in some embodiments, the top-side length PL and/or the bottom side length BL can be between 0.05 and 0.25, 0.15 and 0.35, 0.25 and 0.45, 0.35 and 0.55, 0.45 and 0.65, 0.55 and 0.75, 0.65 and 0.85, or 0.75 and 0.1 inches. In the illustrated embodiment, the top-side length PL and the bottom-side length BL are the same. In other embodiments, the top-side length PL can be greater than the bottom-side length BL, or the bottom-side length BL can be greater than the top-side length PL.

In the illustrated embodiment, the toe-side length TL is 0.546 inches, and the heel-side length HL is 0.312 inches. In other embodiments, the toe-side length TL can range from 0.2 to 1.5 inches. For example, in some embodiments, the toe-side length TL can range from 0.2 to 0.4, 0.3 to 0.5, 0.4 to 0.6, 0.5 to 0.7, 0.6 to 0.8, 0.7 to 0.9, 0.8 to 1.0, 0.9 to 1.1, 1.0 to 1.2, 1.1 to 1.3, 1.2 to 1.4, or 1.3 to 1.5 inches. Further, in other embodiments, the heel-side length HL can range from 0.1 to 0.7 inches. For example, in some embodiments, the heel-side length HL can range from 0.1 to 0.3, 0.2 to 0.4, 0.3 to 0.5, 0.4 to 0.6, or 0.5 to 0.7 inches. The toe-side length is greater than the heel-side length. The difference in between the toe-side length TL and the heel-side length HL generates or forms the ovoid or ellipsoidal or egg-shaped contour displayed in FIG. 6 and enables normalization of CT across the face plate 120.

In the illustrated embodiment, the central region 150 has a thickness of 0.135. In other embodiments, the thickness of the central region 150 can vary from 0.070 to 0.25 inches. For example, in some embodiments, the thickness of the central region 150 can be from 0.07 to 0.1, 0.09 to 0.1, 0.095 to 0.105, 0.1 to 0.12, 0.105 to 0.115, 0.11 to 0.12, 0.115 to 0.125, 0.12 to 0.13, 0.125 to 0.135, 0.13 to 0.14, 0.135 to 0.145, 0.14 to 0.15, 0.145 to 0.155, 0.15 to 0.17, 0.16 to 0.18, 0.17 to 0.2, 0.19 to 0.22, or 0.21 to 0.25 inches. Further, in the illustrated embodiment, the central region 150 comprises 6% of the total surface area of the face plate 120. In other embodiments, the central region 150 can comprise less than 5%, less than 10%, less than 15%, less than 20%, less than 25%, or less than 30% of the total surface area of the face plate 120. For example, the central region 150 can comprise 2-10%, 5-10%, 2-15%, 5-15%, or 5-20% of the total surface area of the face plate 120.

In many embodiments, the central region 150 is disposed at an angle on the rear surface 126 of the face plate 120 of the club head 100. Specifically, the major axis 155 of the central thickened region 150 is disposed at an angle with respect to the x-axis 2. The angle can be configured such that the first side 151 or long portion of the central region 150 extends from the geometric center 129 of the face plate 120 towards the upper-toe portion of the face plate 120, wherein the regions of inherently high CT exist.

In the illustrated embodiment, the minor axis 153 of the central region 150 forms an angle of 20 degrees with the y-axis 4. In other embodiments, the minor axis 153 of the central region 150 can form an angle of 2 to 60 degrees with the y-axis 4. For example, in some embodiments, the minor axis 153 of the central region 150 and the y-axis 4 can create an angle between 2 to 20, 2 to 30, 5 to 40, 10 to 50, or 15 to 60 degrees. In other embodiments, the minor axis 152 of the central thickened region 150 can create an angle of 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, or 60 degrees with the y-axis 4.

Further, in the illustrated embodiment, the major axis 155 of the central region 150 forms an angle of 20 degrees with the x-axis 2. In general, the angle formed between the major axis of the central region 150 and the x-axis 2 is the same as the angle formed between the minor axis 153 of the central region 150 and the y-axis. For example, the angle formed between the major axis 155 of the central region 150 and the x-axis 2 can vary from 0 to 60 degrees. In some embodiments, the angle formed between the major axis 155 of the central region 150 and the x-axis 2 can vary from 2 to 20, 2 to 30, 5 to 40, 10 to 50, or 15 to 60 degrees. In other embodiments, the major axis 155 of the central region 150 can create an angle of 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, or 60 degrees with the x-axis 2. By disposing the central thickened region 150 on an angle it further allows the elongated portion of the egg-shape to extend towards the upper-toe portion if the face plate 120 wherein high CT values exist.

ii. Transition Region

Referring to FIGS. 6 and 7, the transition region 160 of the variable face thickness 140 extends from the perimeter of the central thickened region 150 to the peripheral region 170. In the illustrated embodiment, the transition region 160 gradually tapers from a thickest portion near the perimeter of central thickened region 150 towards a thinnest region near or adjacent to the peripheral region 170. The thickest region of the transition region 160 can be equal to or slightly less than the thickness of the central thickened region 150, while the thinnest region of the transition region 160 can be equal to, or slightly greater than the peripheral region 170.

In many embodiments, the transition region 160 includes a varying thickness that creates a smooth transition between the central region 150 and the peripheral region 160. Specifically, referring to FIGS. 6 and 7, the thickness of the face plate 120 in the transition region 160 of the club head 100 varies at least partially with a curved or rounded or curvilinear profile. In the illustrated embodiment, the thickness of the face plate 120 in the transition region 160 comprises a blended taper between the maximum face plate thickness in the central region 150 and the minimum face plate thickness in the peripheral region 170. In many embodiments, the curved or blended tapered profile comprises a first radius of curvature between the central region 150 and the transition region 160 and a second radius of curvature between the transition region 160 and the peripheral region 170. Further, in many embodiments, the thickness profile of the transition region 160 comprises a gradual taper between the first radius of curvature and the second radius of curvature. In other embodiments, the thickness of the face plate 120 in the transition region 160 can vary according to an entirely curved profile, such as a convex profile, a concave profile, a sinusoidal profile, a parabolic profile, or any other curved profile. Further, in other embodiments, the thickness of the face plate 120 in the transition region 160 can vary according to any profile including straight and/or curved geometries.

In many embodiments, the transition region 160 can comprise a shape similar to or corresponding to the shape of the central region 150. In the illustrated embodiment, the transition region 160 extends a constant or fixed distance of 0.45 inches from the perimeter of the central thickened region 150 to the peripheral region 170. In other embodiments, the transition region can extend from 0.15 to 0.75 inches from the perimeter of the central thickened region 150 to the peripheral region 170. For example, in some embodiments, the transition region 160 can extend between 0.15 to 0.35, 0.25 to 0.45, 0.35 to 0.55, 0.45 to 0.65, or 0.55 to 0.75 inches from the perimeter of the central thickened region 150 to the peripheral region 170. In yet another embodiment, the distance the transition region 160 extends from the perimeter of the central thickened region 150 can vary. For example, the length of the transition region 160 extending towards the top portion 121 of the face plate 120 can be greater or less than the length of the transition region 160 extending towards the bottom portion 122 of the face plate 120. In other embodiments, the length of the transition region 160 extending in any direction from the central thickened region 160 can be greater than, less than or the same as the length of the transition region 160 extending in any other direction from the central thickened region.

Further, in the illustrated embodiment, the transition region 160 comprises 27% of the total surface area of the face plate 120. In other embodiments, the transition region 160 can comprise between 10% and 70% of the total surface area of the face plate 120. For example, in some embodiments, the transition region 160 can comprise between 10% to 30%, 20% to 40%, 30% to 50%, 40% to 60%, or 50% to 70% of the total surface area of the face plate 120.

iii. Peripheral Region

Referring again to FIGS. 6 and 7, the peripheral region 170 of the variable thickness profile 140 extends from the perimeter of the transition region 160 to the perimeter of the face plate 120. In the illustrated embodiment, the thickness of the peripheral region 170 is 0.85 inches. In other embodiments, the thickness of the peripheral region 170 can be less than 0.15 inches. For example, in some embodiments, the peripheral region 170 can be less than 0.15 inches, less than 0.1 inches, less than 0.09 inches, less than 0.08 inches, less than 0.07 inches, less than 0.06 inches, less than 0.05 inches, or less than 0.04 inches. Further, in the illustrated embodiment, the peripheral region 170 comprises 67% of the total surface area of the face plate 120. In other embodiments, the peripheral region 170 can comprise 30% to 90% of the total surface area of the face plate 120. For example, in some embodiments, the peripheral region 170 can comprise between 30% to 50%, 40% to 60%, 50% to 70%, 60% to 80%, or 70% to 90% of the total surface area of the face plate 120.

iv. Variable Thickness Profile Relative to Face Plate Quadrants

Referring to FIG. 5, the face plate 120 can comprise four quadrants, including: an upper heel-side quadrant 120A, an upper toe-side quadrant 120B, a lower heel-side quadrant 120C, and a lower toe-side quadrant 120D. The upper heel-side quadrant 120A extends heel-ward (toward the heel) from the y-axis 4 and crown-ward (toward the crown) from x-axis 2 to the outer periphery of the face plate 120. The upper toe-side quadrant 120B extends toe-ward (toward the toe) from the y-axis 4 and crown-ward (toward the crown) from the x-axis 2 to the outer periphery of the face plate 120. The lower heel-side quadrant 120C extends heel-ward (toward the heel) from the y-axis 4 and sole ward (toward the sole) from x-axis 2 to the outer periphery of the face plate 120. The lower toe-side quadrant 120D extends toe-ward from the y-axis 4 and sole ward from x-axis 2 to the outer periphery of the face plate 120.

The central region 150 can extend at least partially into all four quadrants of the face plate 120A, 120B, 120C, 120D. Each quadrant of the face plate 120 can comprise different portions or percentages of the total surface area of the central region 150. In many embodiments, a greater percentage of the total surface area of the central region 150 is located in the upper toe-side quadrant 120B than in one or more of the lower heel-side quadrant 120C, the upper heel-side quadrant 120A, and the lower toe-side quadrant 120D. Further, in many embodiments, the lower heel-side quadrant 120C comprises a lower percentage of the total surface area of the central region 150 than one or more of the upper toe-side quadrant 120B, the upper heel-side quadrant 120A, and the lower toe-side quadrant 120D. In some embodiments, surface area of the central thickened region 150 within the upper heel-side quadrant 120A can be the same as or similar to the surface area of the central thickened region 150 within the lower toe-side quadrant 120D.

In the illustrated embodiment, the upper toe-side quadrant 120B comprises 38% of the total surface area of the central region 150, the lower heel-side quadrant 120C comprises 19% of the total surface area of the central region 150, the lower toe-side quadrant 120D comprises 25% of the total surface area of the central region 150, and the upper heel-side quadrant 120A comprises 18% of the total surface area of the central region 150.

In many embodiments, the upper toe-side quadrant 120B can comprise greater than 25%, greater than 30%, greater than 35%, greater than 40%, greater than 45%, or greater than 50% of the total surface area of the central region 150. For example, in some embodiments, the upper toe-side quadrant 120B can comprise 30-50% of the total surface area of the central region 150. Further, in many embodiments, the lower heel-side quadrant 120C can comprise less than 30%, less than 25%, less than 20%, less than 15%, less than 10%, or less than 5% of the total surface area of the central region 150. For example, in some embodiments, the lower heel-side quadrant 120C can comprise 5-20% of the total surface area of the central region 150. Further still, in many embodiments, the lower toe-side quadrant 120D and/or the upper heel-side quadrant 120A can comprise between 15-30% of the total surface area of the central region 150.

The transition region 160 can extend at least partially into all four quadrants of the face plate 120A, 120B, 120C, 120D. Each quadrant of the face plate 120 can comprise different portions or percentages of the total surface area of the transition region 160. In many embodiments, a greater percentage of the surface area of the transition region 160 is located in the upper toe-side quadrant 120B than in one or more of the lower heel-side quadrant 120C, the upper heel-side quadrant 120A, and the lower toe-side quadrant 120D. Further, in many embodiments, the lower heel-side quadrant 120C comprises a lower percentage of the total surface area of the transition region 160 than one or more of the upper toe-side quadrant 120B, the upper heel-side quadrant 120A, and the lower toe-side quadrant 120D. In some embodiments, surface area of the transition region 160 within the upper heel-side quadrant 120A can be the same as or similar to the surface area of the transition region 160 within the lower toe-side quadrant 120D.

In many embodiments, the upper toe-side quadrant 120B can comprise greater than 25%, greater than 30%, greater than 35%, greater than 40%, greater than 45%, or greater than 50% of the total surface area of the transition region 160. For example, in some embodiments, the upper toe-side quadrant 120B can comprise 30-50% of the total surface area of the transition region 160. Further, in many embodiments, the lower heel-side quadrant 120C can comprise less than 30%, less than 25%, less than 20%, less than 15%, less than 10%, or less than 5% of the total surface area of the transition region 160. For example, in some embodiments, the lower heel-side quadrant 120C can comprise 5-20% of the total surface area of the transition region 160. Further still, in many embodiments, the lower toe-side quadrant 120D and/or the upper heel-side quadrant 120A can comprise between 15-30% of the total surface area of the transition region 160.

v. Benefits

The oval or ovoid or ellipsoidal or egg-like shape, along with the angle of the central region 150 of the variable thickness profile 140, enables thicker regions of the face plate 120 to be positioned in regions having inherently high CT, and thinner regions of the face plate 120 to be positioned in regions having inherently low CT. Accordingly, regions of the face having inherently high CT are reduced, and regions of the face having inherently low CT are increased, resulting in normalized CT across the face plate 120 and an increased average CT of the face plate 20. In many embodiments, the variable thickness profile 140 results in a range in characteristic time less than 115 seconds, less than 110 seconds, less than 105 seconds, less than 100 seconds, less than 95 seconds, less than 90 seconds, or less than 85 seconds. Further, in many embodiments, the variable thickness profile 140 results in an average characteristic time greater than 230 seconds, greater than 235 seconds, or greater than 240 seconds. For example, in many embodiments, the average CT of the face plate 20 can be between 230 seconds and 240 seconds, between 235 seconds and 240 seconds, or between 240 seconds and 245 seconds.

Further, because the angled VFT is designed to position thickened portions of the face plate 120 in regions where it is required, the face plate can experience a weight reduction compared to a face plate devoid of the variable thickness profile 140 described herein. The extra discretionary weight can be re-introduced in other regions of the club head to manipulate the club head center of gravity position and to increase club head moment of inertia, further improving the performance of the club head. In the illustrated embodiment, the club head 100 having the variable thickness profile 140, as described herein, saves 2.1 grams of weight compared to a similar club head devoid of the variable thickness profile 140.

III. Golf Club Head Having Normalized CT According to Another Embodiment

Figure 10:
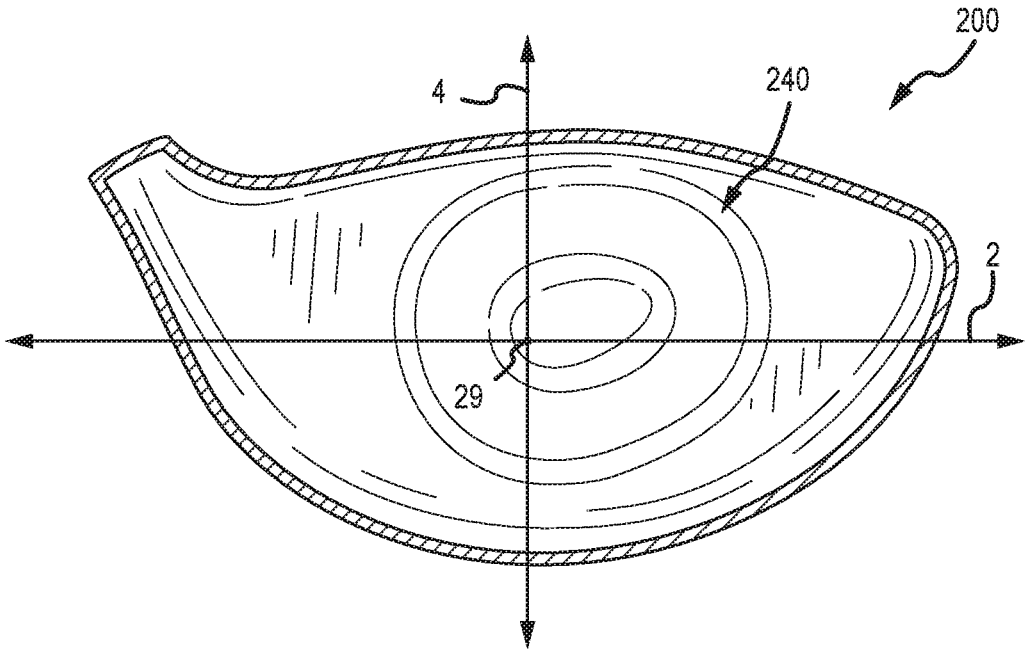
FIG. 10 is a rear cross-sectional view of an exemplary golf club head according to another embodiment.

Referring to FIG. 10, another embodiment of a golf club head 200 having a normalized CT is illustrated. The club head 200 comprises a body and a face plate or strike face having a variable thickness profile 240. The body of club head 200 can be similar or identical to body 30 of club head 10 and/or body 130 of club head 100. The face plate of club head 200 can be similar to face plate 20 of club head 10 or face plate 120 of club head 100, except for the positioning of the variable thickness profile relative to the geometric center 29 of the face plate.

For example, the variable thickness profile 240 comprises a central region, a transition region, and a peripheral region. The central region of club head 200 can be similar or identical to central region 50 of club head 10 or central region 150 of club head 100. The transition region of club head 200 can be similar or identical to transition region 60 of club head 10 or transition region 160 of club head 100. The peripheral region of club head 200 can be similar or identical to peripheral region 70 of club head 10 or peripheral region 170 of club head 100.

In the illustrated embodiment of FIG. 10, the variable thickness profile 240 is positioned or located on the face plate such that the center of the central region does not align with the geometric center 29 of the face plate. In the illustrated embodiment, the center of the central region is located closer to the top portion and closer to the toe portion than the geometric center 29 of the face plate. In other embodiments, the center of the central region can be located closer to one or more of the top portion, the toe portion, the bottom portion, or the heel portion compared to the geometric center 29 of the face plate.

The club head 200 having the variable thickness profile 240 can result in normalized CT across the face plate and an increased average CT of the face plate, similar to club head 10 and club head 100, compared to a club head devoid of the variable thickness profile 240 described herein.

IV. Golf Club Head Having Normalized CT According to Another Embodiment

Figure 12:
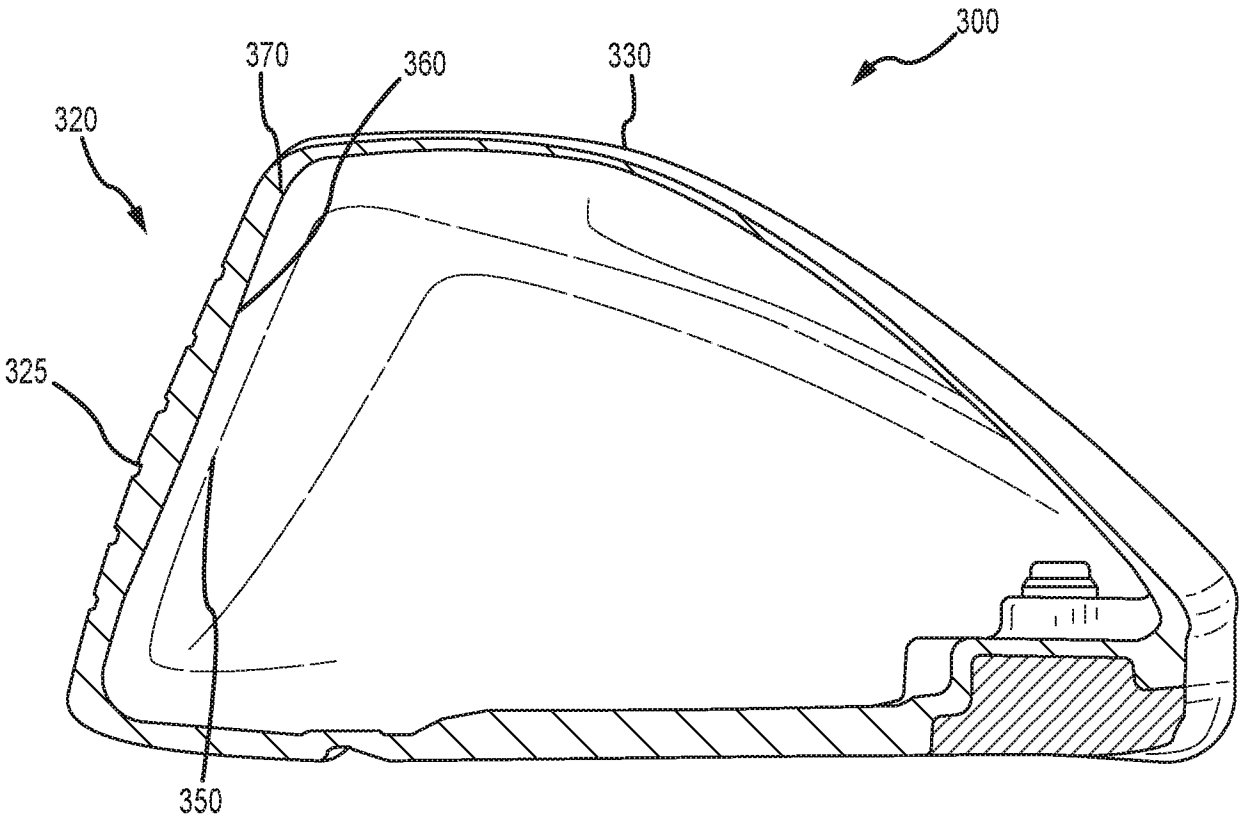
FIG. 12 is a side cross-sectional view of the golf club head of FIG. 11.

Referring to FIGS. 11 and 12, a golf club head 300 having a face plate 320 with a normalized CT is shown. The golf club head 300 comprises a body 330 and a faceplate 320 having a variable thickness profile 340. The faceplate 320 and the body 330 are coupled together to form the club head 300 defining a hollow interior or hollow inner cavity. In many embodiments, the club head 300 can be similar or identical to the aforementioned characteristics, elements, and/or features of golf club head 10, 100, and 200.

In one or more embodiments of the golf club head 10, 100 and 200, the positioning of the central region 50, 150, and 250 of the variable face thickness profile need not to be relatively positioned to a face height criterion. As will be described below, FIGS. 11 and 12 illustrate vertically aligning the central region of the variable thickness profile 340 with respect to the maximum height of the faceplate 320, as this can be a location where inherently high CT exists. Further, in this particular embodiment, the maximum height of the faceplate 320 is not vertically aligned with the geometric center of the faceplate (e.g., offset toeward from the geometric center of the faceplate) to counterbalance the mass induced by the hosel to provide a more optimum club head center of gravity location.

In other words, the location of where the maximum height of the faceplate 320 occurs can create an inherently high CT area (due to surface area). Therefore, to further control and normalize CT across the faceplate, the center of the central region 350 of the variable thickness profile 340 can be vertically aligned with respect to the maximum height of the face plate 320. Vertically controlling the center of the central region 350 of the variable face thickness profile 340 with respect to the maximum height of the face plate 320 permits the maximum width of the central region to be aligned with the maximum height of the faceplate 320. Therefore, as the central region 350 is generally thickest relative to other faceplate regions (e.g., the transition region or peripheral region) more of the central region surface area is allocated towards the region of the faceplate 320 having inherently high CT (e.g., in many embodiments towards the toe of the faceplate).

Furthermore, controlling the position of the central region 350 with respect to a specified face height criterion increases the amount of discretionary weight compared to faceplates devoid of the variable face thickness profile described herein, as the transition region and the peripheral region need not to be thickened. In the illustrated embodiment, the club head 300 described herein, saves approximately between two and four grams of weight compared to alternative variable face thickness.

Face Plate Having Variable Thickness Profile

The face plate 320 comprises a top or top portion 321, a bottom or bottom portion 322, toe or toe portion 323, a heel or heel portion 324, a front surface 325, a rear surface 326, and a variable face thickness (VFT) or variable thickness profile 340. The face plate 320 can be a planar surface or the face plate 320 can have a bulge and/or roll curvature.

vi. Central Region

In the illustrated embodiment of FIGS. 11 and 12, the central region 350 of the variable thickness profile 340 comprises an ellipse (or ellipse-like) shape. The central region 350 is generally oblong and extends from a portion of the face plate 320 near the bottom 322 and heel 324 to a portion of the face plate 320 near the toe 323 and top 321.

The shape of the central region 350 defines a major axis 355 extending in a general heel 323 to toe 324 direction and a minor axis 353 extending generally in a top 321 to bottom 322 direction. The major axis 355 and the minor axis 353 intersect at a center of the central region 350. The major axis 355 extends along a length of the central region 350, and the minor axis 353 extends along a maximum width of the central region 350. In this particular embodiment, the major axis of the central region 350 extends parallel (and/or non-angled) to the x-axis 2.

In the illustrated embodiment of FIG. 11, the center of the central region 350 can be offset toeward from the geometric center 329 of the face plate 320 by approximately 0.210 inch to be vertically aligned with the maximum height of the faceplate 320, which is measured from the top 321 of the faceplate to the bottom 322 of the faceplate 320. In other embodiments, the center of the central region 350 can be offset toeward from the geometric center 329 of the face plate 320 by at least 0.100 inch, at least 0.110 inch, at least 0.120 inch, at least 0.130 inch, at least 0.140 inch, at least 0.150 inch, at least 0.160 inch, at least 0.170 inch, at least 0.180 inch, at least 0.190 inch, at least 0.200 inch, at least 0.210 inch, at least 0.220 inch, at least 0.230 inch, at least 0.240 inch, at least 0.250 inch, at least 0.260 inch, at least 0.270 inch, at least 0.280 inch, at least 0.290 inch, or at least 0.300 inch.

The central region 350 comprises a first side or toe side 351 and a second side or heel side 352. The first side 351 and second side 352 of the central region 350 are separated by the minor axis 353. The first side is positioned between the minor axis 353 and the toe portion 323, and the second side is positioned between the minor axis 353 and the heel portion 324. The length of the first side 351, measured along the major axis 355, is equivalent (or substantially similar) to the length of the second side 352.

In many embodiments, the combined length of the first side 351 and the second side 352 can be greater than approximately 0.75 inch, greater than approximately 0.80 inch, greater than approximately 0.85 inch, greater than approximately 0.90 inch, greater than approximately 0.95 inch, or greater than approximately 1.0 inch. In other embodiments, the combined length of the first side 351 and the second side 352 can be approximately 1.0 inch, 1.1 inches, 1.2 inches, 1.3 inches, or 1.4 inches.

In the illustrated embodiment, the central region 350 further comprises a top-side length PL measured along the minor axis 353 from the center of the central region 350 toward the top 321, and a bottom-side length BL measured along the minor axis 352 from the center of the central region 350 toward the bottom 322. In this embodiment, the top-side length PL and the bottom-side length BL are equivalent (or substantially similar) in length.

In the illustrated embodiment, the top-side length PL and the bottom side length BL are approximately 0.285 inches. In other embodiments, the top-side length PL and/or the bottom side length BL can be between 0.05 and 1.0 inches. For example, in some embodiments, the top-side length PL and/or the bottom side length BL can be between 0.05 and 0.25, 0.15 and 0.35, 0.25 and 0.45, 0.35 and 0.55, 0.45 and 0.65, 0.55 and 0.75, 0.65 and 0.85, or 0.75 and 0.1 inches.

In the illustrated embodiment, the central region 350 has a thickness of 0.135. In other embodiments, the thickness of the central region 350 can vary from 0.070 to 0.25 inches. For example, in some embodiments, the thickness of the central region 350 can be from 0.07 to 0.1, 0.09 to 0.1, 0.095 to 0.105, 0.1 to 0.12, 0.105 to 0.115, 0.11 to 0.12, 0.115 to 0.125, 0.12 to 0.13, 0.125 to 0.135, 0.13 to 0.14, 0.135 to 0.145, 0.14 to 0.15, 0.145 to 0.155, 0.15 to 0.17, 0.16 to 0.18, 0.17 to 0.2, 0.19 to 0.22, or 0.21 to 0.25 inches. In many embodiments, the central region 350 can comprise less than 5%, less than 10%, less than 15%, less than 20%, less than 25%, or less than 30% of the total surface area of the face plate 320. For example, the central region 350 can comprise 2-10%, 5-10%, 2-15%, 5-15%, or 5-20% of the total surface area of the face plate 320.

vii. Benefits

As described above, aligning the center of the ellipse (or ellipse-like) central region of the variable face thickness profile with respect to the maximum height of the face plate permits the maximum width of the central region to be positioned where inherently height CT occurs. This enables more of the central region surface area to be allocated towards regions having inherently high CT, to reduce CT. Additionally, aligning the maximum height of the faceplate 320 with the center of the central region allows for a more optimum club head center of gravity location, while still beneficially reducing CT.

viii. Transition Region

Referring to FIGS. 11 and 12, the transition region 360 of the variable face thickness 340 extends from the perimeter of the central thickened region 350 to the peripheral region 370. In the illustrated embodiment, the transition region 360 gradually tapers from a thickest portion near the perimeter of central thickened region 350 towards a thinnest region near or adjacent to the peripheral region 370. The thickest region of the transition region 360 can be equal to or slightly less than the thickness of the central thickened region 350, while the thinnest region of the transition region 360 can be equal to, or slightly greater than the peripheral region 370.

In many embodiments, the transition region 360 includes a varying thickness that creates a smooth transition between the central region 350 and the peripheral region 360. Specifically, referring to FIG. 11, the thickness of the face plate 320 in the transition region 360 of the club head 300 varies at least partially with a curved or rounded or curvilinear profile. In the illustrated embodiment, the thickness of the face plate 320 in the transition region 360 comprises a blended taper between the maximum face plate thickness in the central region 350 and the minimum face plate thickness in the peripheral region 370. In many embodiments, the curved or blended tapered profile comprises a first radius of curvature between the central region 350 and the transition region 360, and a second radius of curvature between the transition region 360 and the peripheral region 370. Further, in many embodiments, the thickness profile of the transition region 360 comprises a gradual taper between the first radius of curvature and the second radius of curvature. In other embodiments, the thickness of the face plate 320 in the transition region 360 can vary according to an entirely curved profile, such as a convex profile, a concave profile, a sinusoidal profile, a parabolic profile, or any other curved profile. Further, in other embodiments, the thickness of the face plate 320 in the transition region 360 can vary according to any profile including straight and/or curved geometries.

In many embodiments, the transition region 360 can comprise a shape similar to or corresponding to the shape of the central region 350. In the illustrated embodiment, the transition region can extend from approximately 0.15 to approximately 0.75 inches from the perimeter of the central thickened region 350 to the peripheral region 370. For example, in some embodiments, the transition region 360 can extend between 0.15 to 0.35, 0.25 to 0.45, 0.35 to 0.55, 0.45 to 0.65, or 0.55 to 0.75 inches from the perimeter of the central thickened region 350 to the peripheral region 370. For example, the length of the transition region 360 extending in any direction from the central thickened region 360 can be greater than, less than or the same as the length of the transition region 360 extending in any other direction from the central thickened region.

ix. Peripheral Region

Referring again to FIG. 11, the peripheral region 370 of the variable thickness profile 340 extends from the perimeter of the transition region 360 to the perimeter of the face plate 320. As described above, in many embodiments, the thickness of the peripheral region 370 is 0.85 inches. In other embodiments, the thickness of the peripheral region 370 can be less than 0.15 inches. For example, in some embodiments, the peripheral region 370 can be less than 0.15 inches, less than 0.1 inches, less than 0.09 inches, less than 0.08 inches, less than 0.07 inches, less than 0.06 inches, less than 0.05 inches, or less than 0.04 inches.

EXAMPLE 1

Figure 9:
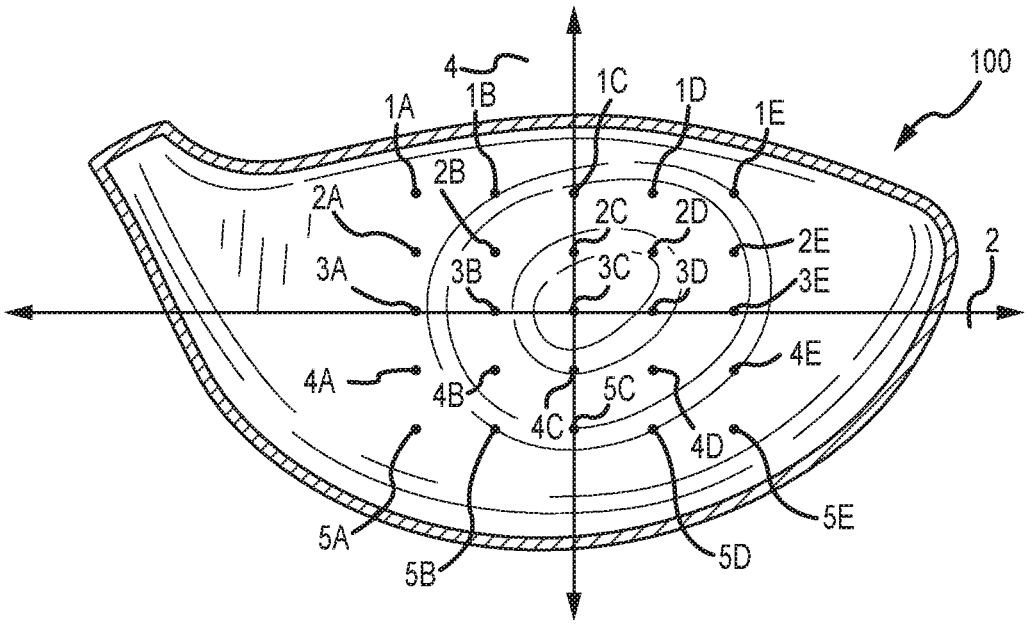
FIG. 9 is a rear cross-sectional view of an exemplary golf club head according to the embodiment of FIG. 6.

Referring to FIG. 9, an exemplary golf club head 100 comprising the variable face thickness 140 having the ovoid shape and the angle with respect to the ground plane, as described above, demonstrated reduced variability in characteristic time (CT) across the face plate 120 and increased average CT, compared to a control club head having a variable face thickness devoid of the ovoid shape and the angle described herein. Specifically, the exemplary club head 100 resulted in a 27% reduction in the range of CT, when measured at 25 locations across the face plate 120, compared to the control club head. Further, the exemplary club head 100 demonstrated a 3.1% increase in average CT of the face plate 20 compared to the control club head.

In this example, the central region 150 of the variable thickness profile 140 of the club head 100 has an angle of 17 degrees with respect to the ground plane. Further, in this example, the ratio of the surface area of the first side 151 to the surface area of the second side 152 of the central portion 150 of the variable thickness profile 140 is 1.76. Further still, in this example, the upper toe-side quadrant 120B of the club head 100 comprises 38% of the total surface area of the central region 150, the lower heel-side quadrant 120C of the club head 100 comprises 19% of the total surface area of the central region 150, the lower toe-side quadrant 120D of the club head 100 comprises 25% of the total surface area of the central region 150, and the upper heel-side quadrant 120A of the club head 100 comprises 18% of the total surface area of the central region 150.

In this example, the control club head has a variable thickness profile that is symmetric with respect to the x-axis and y-axis of the club head (i.e. not positioned at an angle to with respect to the x-axis and/or the y-axis). Further, in this example, the ratio of the surface area of the first side to the surface area of the second side of the central portion of the variable thickness profile of the control club head is 1.0. Further still, the upper toe-side quadrant, the upper heel-side quadrant, the lower toe-side quadrant, and the lower heel-side quadrant of the control club head each comprise 25% of the total surface area of the central region of the variable thickness profile.

The characteristic time (CT) of the exemplary club head 100 and the control club head were measured at 25 locations on the face plate to determine local CT values. FIG. 9 illustrates the 25 positions (i.e. 1A-1E, 2A-2E, 3A-3E, 4A-4E, and 5A-5E) of the exemplary club head 100, wherein the each point is spaced from an adjacent point by a distance of 0.42 inch in a heel to toe direction for a total grid width of 1.68 inches. Further, each point is spaced from an adjacent point by a distance of 0.36 inch in a crown to sole direction for a total grid height of 1.42 inches.

Table 1 below shows the CT results of the exemplary club head 100 compared to the control club head. The range in CT for the 25 measured locations of the control club head was 133 seconds. The range in CT for the 25 measured locations of the exemplary club head 100 was 97 seconds. These results show that the range in CT of the exemplary club head 100 was 27% lower than the range in CT of the control club head. Accordingly, the variable thickness profile 140 described herein significantly reduces the variability in CT across the face, resulting in normalized CT, compared to a variable thickness profile devoid of the shape and/or angle described herein.

TABLE 1

Characteristic Time for Exemplary Club Head 100 Compared to Control Club Head
Characteristic Time (seconds), Exemplary Club Head 100

| Position | A | B | C | D | E |
|---|---|---|---|---|---|
| 1 | 212 | 218 | 219 | 214 | 197 |
| 2 | 237 | 234 | 227 | 240 | 242 |
| 3 | 234 | 235 | 235 | 240 | 245 |
| 4 | 204 | 221 | 224 | 229 | 214 |
| 5 | 148 | 177 | 191 | 180 | 152 |
| 1 | 210 | 219 | 220 | 207 | 184 |
| 2 | 234 | 233 | 226 | 231 | 222 |
| 3 | 225 | 227 | 229 | 229 | 221 |
| 4 | 200 | 213 | 218 | 215 | 203 |
| 5 | 155 | 172 | 181 | 177 | 151 |
| 1 | 197 | 214 | 219 | 218 | 212 |
| 2 | 242 | 240 | 227 | 234 | 237 |
| 3 | 245 | 240 | 235 | 235 | 234 |
| 4 | 214 | 229 | 224 | 221 | 204 |
| 5 | 152 | 180 | 191 | 177 | 148 |
| 1 | 212 | 218 | 220 | 214 | 197 |
| 2 | 237 | 234 | 226 | 240 | 242 |
| 3 | 234 | 235 | 229 | 240 | 245 |
| 4 | 204 | 221 | 218 | 229 | 214 |
| 5 | 148 | 177 | 181 | 180 | 152 |

In addition, the data in Table 1 shows higher CT values in the heel region (e.g. at points 1A, 2A, 3A, 4A, and 5A) of the exemplary club head 100 compared to the control club head. For example, the average CT of the exemplary club head 100 in quadrant 120A (e.g. points 1A, 2A, 1B, and 2B) increased compared to the control club head from approximately 211.0 seconds to 223.3 seconds as a result of the variable thickness profile 140. For further example, the average CT of the exemplary club head 100 in quadrant 120C (e.g. points 4A, 5A, 4B, and 5B) increased compared to the control club head from approximately 186.5 seconds to 193.8 seconds. Table 1 below depicts the average CT values for groups A, B, C, and D from one test.

The exemplary club head 100 further demonstrated an increase in average CT across the face plate 120 compared to the control club head of 1.2-3.1%. Specifically, the average CT of various samples of the control club heads was 208 seconds, and the average CT of various samples of the exemplary club head 100 was 214.8 seconds.

Normalized CT of the club head 100, demonstrated herein, can result in increased consistency for off-center shots compared to a club head devoid of the variable thickness profile 140. Further, increased average CT of the exemplary club head 100, demonstrated herein, can result in increased ball speed and travel distance compared to a club head devoid of the variable thickness profile 140.

EXAMPLE 2

An exemplary golf club head 300 comprising the variable face thickness 340 with an ellipsoidal shaped central region (shifted towards the toe by 0.21 inch to be vertically aligned with the maximum height of faceplate), demonstrated reduced variability in characteristic time (CT) across the face plate 320 and reduced inherently high CT locations between 5% and 18%, compared to a control club head having a variable face thickness of a central region with an ellipsoidal shape devoid of a toe-ward shift. Further still, referring to FIG. 11, shifting or offsetting the ellipsoidal central region toeward, directly correlates to a face thickness increase towards the toe, while simultaneously decreasing the face thickness towards the heel. Therefore, as the bending/flexing characteristics (e.g, increase flexing/bending characteristics results a higher CT) of the faceplate is determined in part by the face height, shifting the central region to be vertically aligned with maximum height of the face efficiently positions thickened portions where required (i.e. toeward) and creates thinned regions at inherently low CT regions to reduce weight in the faceplate.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

The invention claimed is:

1. A golf club head comprising:

a body having a crown portion, a sole portion, a toe portion, a heel portion, and a rear portion defining an inner cavity;

a face plate having:

a front surface;

a rear surface;

a geometric center of the face plate defining the origin of a coordinate system having a horizontal axis extending from near the heel portion to near the toe portion in a direction parallel to a ground plane when the golf club head is held at an address position, and a vertical axis extending from near the crown portion to near the sole portion, perpendicular to the horizontal axis, and to the ground plane when the golf club head is at an address position;

a maximum face plate height, measured in a sole portion to crown portion direction, parallel to the vertical axis, and offset toeward from the geometric center by at least 0.2 inch, measured in a direction perpendicular to the vertical axis;

a thickness measured between the front surface and the rear surface, wherein the thickness varies at different locations across the face plate to define a variable thickness profile, the variable thickness profile comprising:

a peripheral region comprising a minimum thickness of the face plate;

an ellipsoidal central region comprising a maximum thickness of the face plate, and wherein a center of the ellipsoidal central region is vertically aligned at a location where the maximum face plate height occurs; and a transition region between the peripheral region and the ellipsoidal central region;

wherein:

the ellipsoidal central region further comprises a major axis that extends along a maximum width of the ellipsoidal central region;

the ellipsoidal central region further comprises a minor axis that extends along a maximum height of the ellipsoidal central region;

the major axis and the minor axis intersect at the center of the ellipsoidal central region;

the ellipsoidal central region further comprises a top side length measured along the minor axis from the center of the ellipsoidal central region to a top of the ellipsoidal central region;

the ellipsoidal central region further comprises a bottom side length measured along the minor axis from the center of the ellipsoidal central region to a bottom of the ellipsoidal central region; and the top side length and the bottom side length are equivalent in length.

2. The golf club head of claim 1, wherein the geometric center of the face plate is located in the ellipsoidal central region.

3. The golf club head of claim 1, wherein the thickness of the face plate in the transition region tapers between the maximum thickness of the face plate in the ellipsoidal central region and the minimum thickness of the face plate in the peripheral region.

4. The golf club head of claim 1, wherein the maximum face plate height is located closer to a toe end of the face plate than a heel end of the face plate.

5. The golf club head of claim 1, wherein the ellipsoidal central region further comprises a first side and a second side, wherein:

the first side and the second side are separated by the minor axis of the ellipsoidal central region;

the first side is located between the minor axis and the toe portion;

the second side is located between the minor axis and the heel portion; and a ratio measured as the surface area of the first side of the ellipsoidal central region to the surface area of the second side of the ellipsoidal central region is 1.0.

6. The golf club head of claim 1, wherein the face plate comprises an upper heel-side quadrant, a upper toe-side quadrant, a lower heel-side quadrant, and a lower toe-side quadrant, wherein a greater percentage of the total surface area of the ellipsoidal central region is located in the upper toe-side quadrant than in one or more of the lower heel-side quadrant, the upper heel-side quadrant, and the lower toe-side quadrant.

7. A golf club head comprising:

a body having a crown portion, a sole portion, a toe portion, a heel portion, and a rear portion defining an inner cavity;

a face plate having:

a front surface;

a rear surface;

a geometric center of the face plate defining the origin of a coordinate system having a horizontal axis extending from near the heel portion to near the toe portion in a direction parallel to a ground plane when the golf club head is held at an address position, and a vertical axis extending from near the crown portion to near the sole portion, perpendicular to the horizontal axis, and to the ground plane when the golf club head is at an address position;

a maximum face plate height, measured in a sole portion to crown portion direction, parallel to the vertical axis, and offset toeward from the geometric center of the face plate, measured in a direction perpendicular to the vertical axis;

a thickness measured between the front surface and the rear surface, wherein the thickness varies at different locations across the face plate to define a variable thickness profile, the variable thickness profile comprising:

a peripheral region comprising a minimum thickness of the face plate;

a transition region between the peripheral region and the ellipsoidal central region; and an ellipsoidal central region comprising a maximum thickness of the face plate, and wherein a center of the ellipsoidal central region is vertically aligned at a location where the maximum face plate height occurs; and wherein:

the ellipsoidal central region further comprises a major axis that extends along a maximum width of the ellipsoidal central region;

the ellipsoidal central region further comprises a minor axis that extends along a maximum height of the ellipsoidal central region;

the major axis and the minor axis intersect at the center of the ellipsoidal central region;

the ellipsoidal central region further comprises a top side length measured along the minor axis from the center of the ellipsoidal central region to a top of the ellipsoidal central region;

the ellipsoidal central region further comprises a bottom side length measured along the minor axis from the center of the ellipsoidal central region to a bottom of the ellipsoidal central region; and the top side length and the bottom side length are equivalent in length.

8. The golf club head of claim 7, wherein the geometric center of the face plate is located in the ellipsoidal central region.

9. The golf club head of claim 7, wherein the thickness of the face plate in the transition region tapers between the maximum thickness of the face plate in the ellipsoidal central region and the minimum thickness of the face plate in the peripheral region.

10. The golf club head of claim 7, wherein the maximum face plate height is located closer to a toe end of the face plate than a heel end of the face plate.

11. The golf club head of claim 7, wherein the ellipsoidal central region further comprises a first side and a second side, wherein:

the first side and the second side are separated by the minor axis of the ellipsoidal central region;

the first side is located between the minor axis and the toe portion;

the second side is located between the minor axis and the heel portion; and a ratio measured as the surface area of the first side of the ellipsoidal central portion to the surface area of the second side of the ellipsoidal central portion is 1.0.

12. The golf club head of claim 7, wherein the face plate comprises an upper heel-side quadrant, a upper toe-side quadrant, a lower heel-side quadrant, and a lower toe-side quadrant, wherein a greater percentage of the total surface area of the ellipsoidal central region is located in the upper toe-side quadrant than in one or more of the lower heel-side quadrant, the upper heel-side quadrant, and the lower toe-side quadrant.

* * * * *